US010551153B1

(12) United States Patent
Nolan et al.

(10) Patent No.: US 10,551,153 B1
(45) Date of Patent: Feb. 4, 2020

(54) TARGETS

(71) Applicant: ACCURA OUTDOORS, LLC, Nampa, ID (US)

(72) Inventors: Donald E. Nolan, Nampa, ID (US); Jared J. Wilson, Nampa, ID (US)

( * ) Notice: Subject to any disclaimer, the term of this patent is extended or adjusted under 35 U.S.C. 154(b) by 0 days.

(21) Appl. No.: 16/255,730

(22) Filed: Jan. 23, 2019

Related U.S. Application Data

(62) Division of application No. 15/860,265, filed on Jan. 2, 2018, now Pat. No. 10,247,528.

(51) Int. Cl.
*F41J 1/10* (2006.01)
*G09F 7/18* (2006.01)

(52) U.S. Cl.
CPC ..... *F41J 1/10* (2013.01); *G09F 2007/1834* (2013.01)

(58) Field of Classification Search
CPC ..... F41J 1/00; F41J 1/10
USPC .... 273/403–408; 40/607.03, 606.01, 611.13, 40/607.11, 611.06, 611.08
See application file for complete search history.

(56) References Cited

U.S. PATENT DOCUMENTS 4,913,444 A * 4/1990 Hatt ..... F41J 3/0076 273/408
5,211,404 A * 5/1993 Grant ..... F41J 1/01 273/407
RE34,461 E * 11/1993 Buselli ..... A63F 9/0208 273/348.4
5,280,920 A * 1/1994 Knapper, II ..... F41J 1/10 273/407
5,671,924 A * 9/1997 Scott ..... F41J 1/10 273/407
5,921,011 A * 7/1999 Hawver ..... G09F 7/18 248/174
5,947,477 A * 9/1999 Turnipseed ..... F41J 1/10 273/359
6,257,584 B1 * 7/2001 Nasuti ..... F41J 1/10 273/403
2007/0013138 A1 * 1/2007 Hinnant ..... F41J 1/01 273/407
2013/0067784 A1 * 3/2013 Parker ..... G09F 15/02 40/607.03
2014/0091527 A1 * 4/2014 Schneider ..... F41J 1/10 273/407
2014/0284880 A1 * 9/2014 Burks ..... F41J 1/10 273/407
2015/0007471 A1 * 1/2015 Cepek ..... G09F 7/22 40/607.03
2016/0298942 A1 * 10/2016 Skinner ..... F41J 1/10

* cited by examiner

*Primary Examiner* — Mark S Graham
(74) *Attorney, Agent, or Firm* — Michael W. Goltry; Robert A. Parsons; Parsons & Goltry, PLLC

(57) ABSTRACT

A target includes a sheet of a material, the sheet includes an uprange-facing surface, a downrange-facing surface, an upper end, a lower end, and opposed sides each formed with an origami structure. Each origami structure is a partially cut-out and foldable structure formed in the material of the sheet being foldable from an unfolded condition to a folded condition. Each origami structure is flattened in a direction toward the downrange-facing surface of the sheet, when in the unfolded condition, and forms a sleeve structure deployed rearwardly from the downrange-facing surface of the sheet that is adapted to receive a support pole therein for retaining the sheet to the support pole, when in the folded condition.

8 Claims, 31 Drawing Sheets

TARGETS

FIELD OF THE INVENTION

The present invention relates generally to targets.

BACKGROUND OF THE INVENTION

Target shooting is a sport of firing a projectile, such as a bullet or an arrow, at targets of various kinds with rifles, handguns, shotguns, and/or bows. Shooting at a target as a test of skill has its origins with archery, and it was not until much later, after the advent of firearms, that target shooting with firearms became commonplace. Today, target shooting is a popular and competitive activity.

Target shooting can involve shooting at either moving targets or stationary targets. In stationary targets, a target positioned downrange is shot at a number of times from an uprange shooting area, and is then removed and replaced with another target. Typically, the target is supported or suspended above the ground enabling it to be targeted and shot at from the uprange shooting area. The prior art has provided a variety of targets and stands useful for supporting targets to be shot. However, existing targets and stands are cumbersome to assemble, expensive, not easily packaged for shipment or transport, and incorporate fasteners used to secure the targets to the stands that are easily lost or misplaced. Given these and other shortcomings inherent in the art, there is a continuing and ongoing need for improvement in the field of targets.

SUMMARY OF THE INVENTION

According to the principle of the invention, a target includes a sheet of a material, the sheet includes an uprange-facing surface, a downrange-facing surface, an upper end, a lower end, and opposed sides each formed with an origami structure. Each origami structure is a partially cut-out and foldable structure formed in the material of the sheet being foldable from an unfolded condition to a folded condition, wherein each origami structure is flattened in a direction toward the downrange-facing surface of the sheet, when in the unfolded condition, and forms a sleeve structure deployed rearwardly from the downrange-facing surface of the sheet that is adapted to receive a support pole therein for retaining the sheet to the support pole, when in the folded condition. The sheet is flat, when each origami structure is in the unfolded condition. In an exemplary embodiment, each origami structure is in the folded condition, a support pole is inserted into each of the sleeve structures to retain the sheet on the support poles, the uprange-facing surface is flat between the origami structures and between the upper end and the lower end of the sheet, and the support poles are behind the downrange-facing surface. Each sleeve structure includes sleeves, the sleeves being inline and spaced apart between the upper end of the sheet and the lower end of the sheet, when each origami structure is in the folded condition. The material of the sheet is a cardboard.

According to the principle of the invention, a target includes a sheet of a material, the sheet includes an uprange-facing surface, a downrange-facing surface, an upper end, a lower end, opposed sides, and an origami structure formed in each of the opposed sides. Each origami structure includes a hinge formed in the material of the sheet, and pop outs formed in the material of the sheet. The hinge extends in a direction from the lower end of the sheet to the upper end of the sheet, divides the sheet into an outer flap section of the sheet and an inner center section of the sheet, and hinges the flap section to the center section. The flap section includes an upper end, a lower end, and a length from the upper end to the lower end. The pop outs are spaced apart between the upper end of the flap section and the lower end of the flap section, are each concurrently formed in the flap section and the center section, and interrupt the hinge, wherein the hinge is discontinuous. The origami structure is foldable from an unfolded condition to a folded condition. The flap section and the pop outs are flattened in a direction toward the downrange-facing surface of the center section, wherein the flap section, the pop outs, and the center section are flat, when the origami structure is in the unfolded condition. The flap section is folded at the hinge inwardly toward, and extends rearward from, the downrange-facing surface of the center section, the pop outs are popped inwardly from the flap section and rearwardly from the downrange-facing surface of the center section to form sleeves and a stop that are inline and spaced apart between the upper end of the flap section and the lower end of the flap section, when the origami structure is in the folded condition. The sheet is flat, when each origami structure is in the unfolded condition. In an exemplary embodiment, each origami structure is in the folded condition, a support pole is inserted into the sleeves and is received against the stop of each of the origami structures to retain the sheet on the support poles, the uprange-facing surface is flat between the origami structures and between the upper end and the lower end of the sheet, and the support poles are behind the downrange-facing surface of the center section. The hinge is a living hinge. The pop outs each include a segment of the material of the sheet, the segment includes an inner end hinged to the center section via an inner segment hinge of the sheet, an outer end hinged to the flap section via an outer segment hinge formed in the material of the sheet, opposed first and second sides cut away from material of the center section of the sheet and the flap section of the sheet from the inner end of the segment to the outer end of the segment, and an intermediate segment hinge formed in the material of the segment of the sheet, the intermediate segment hinge is between the inner end of the segment and the outer end of the segment and extends from the first side of the segment to the second side of the segment, and defines a first portion of the segment from the inner end of the segment to the intermediate hinge, and a second portion of the segment from the outer end of the segment to the intermediate hinge, wherein the segment is flattened, when the origami structure is in the unfolded condition, and the first portion is folded at the inner segment hinge rearwardly from the downrange-facing surface of the center section, the second portion is folded at the outer segment hinge inwardly from the flap section, and the first portion and the second portion are folded at the intermediate segment hinge inwardly toward one another rearwardly from the downrange-facing surface of the center section and inwardly from the flap section, respectively, when the origami structure is in the folded condition. The inner segment hinge is a living hinge, the outer segment hinge is a living hinge, and the intermediate segment hinge is a living hinge. The material of the sheet is a cardboard.

According to the principle of the invention, a target includes a sheet of a material, the sheet includes an uprange-facing surface, a downrange-facing surface, an upper end, a lower end, opposed sides, a hinged sleeve formed in each of the opposed sides, and each hinged sleeve is formed in the material of the sheet, and is hingedly foldable from an unfolded condition to a folded condition, wherein each hinged sleeve is collapsed in a direction toward the downrange-facing surface of the sheet and disabled from receiving a support pole therein, when in the unfolded condition, and is deployed rearwardly from the downrange-facing surface of the sheet and enabled for receiving a support pole therein, when in the folded condition. The sheet is flat, when each hinged sleeve is in the unfolded condition. In an exemplary embodiment, each hinged sleeve is in the folded condition, a support pole is inserted into each of the hinged sleeves to retain the sheet on the support poles, the uprange-facing surface is flat between the hinged sleeves and between the upper end and the lower end of the sheet, and the support poles are behind the downrange-facing surface. Each hinged sleeve has four sides connected by four sleeve hinges formed in the material of the sheet, wherein the sleeve hinges enable the four sides to translate in parallel planes from the unfolded condition of the hinged sleeve to the folded condition of the hinged sleeve. Each sleeve hinge is a living hinge. The material of the sheet is a cardboard.

BRIEF DESCRIPTION OF THE DRAWINGS

Referring to the drawings.

DETAILED DESCRIPTION

Disclosed herein are targets, portable and inexpensive targets, which, in use, are positioned downrange for being shot at from an uprange shooting area for testing and improving shooting skills.

I

Figure 1:
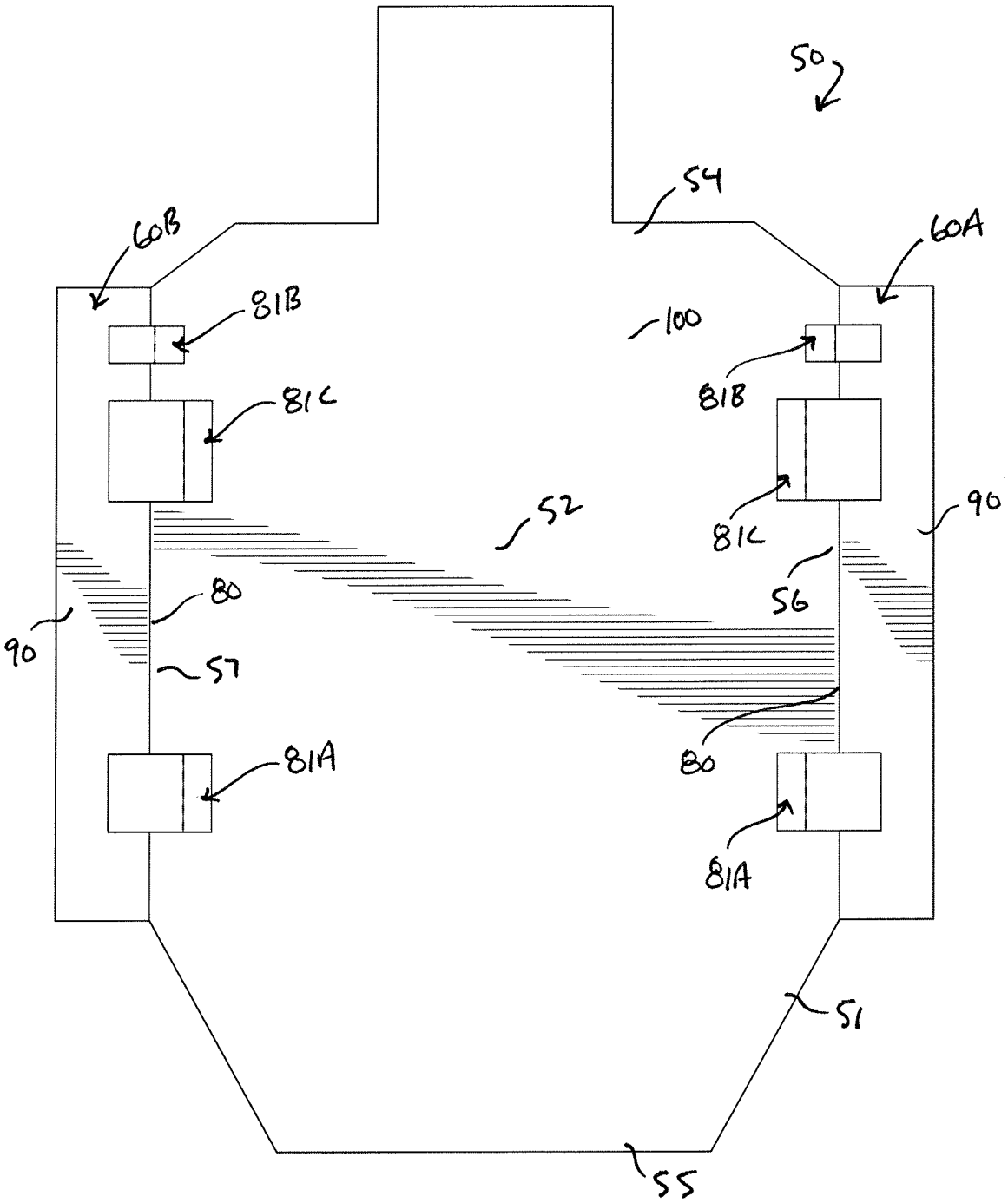
FIG. 1 is an uprange elevation view of a target constructed and arranged in accordance with the principle of the invention, the target includes origami structures shown unfolded.
Figure 2:
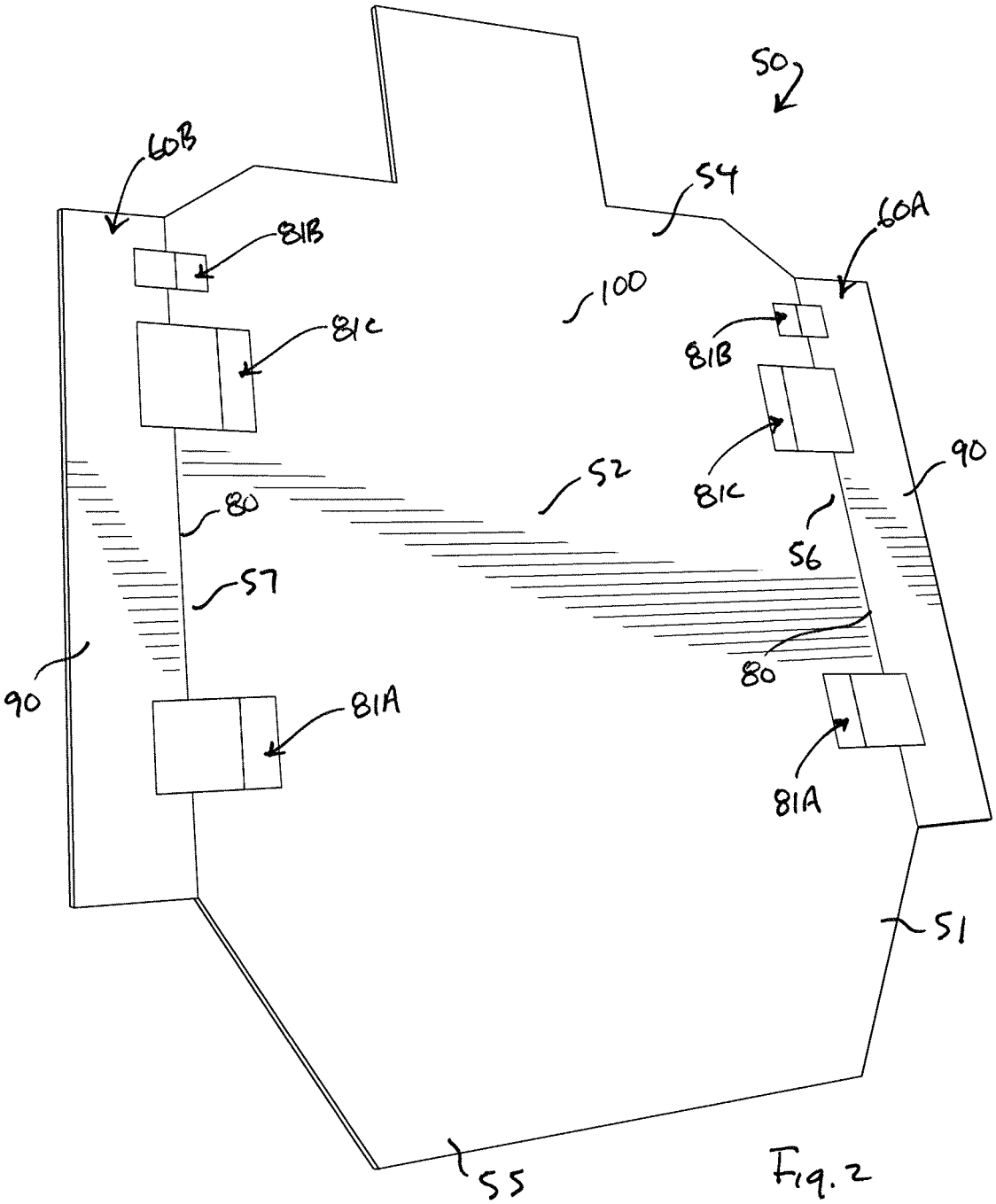
FIG. 2 is a uprange perspective view of the embodiment of FIG. 1.
Figure 3:
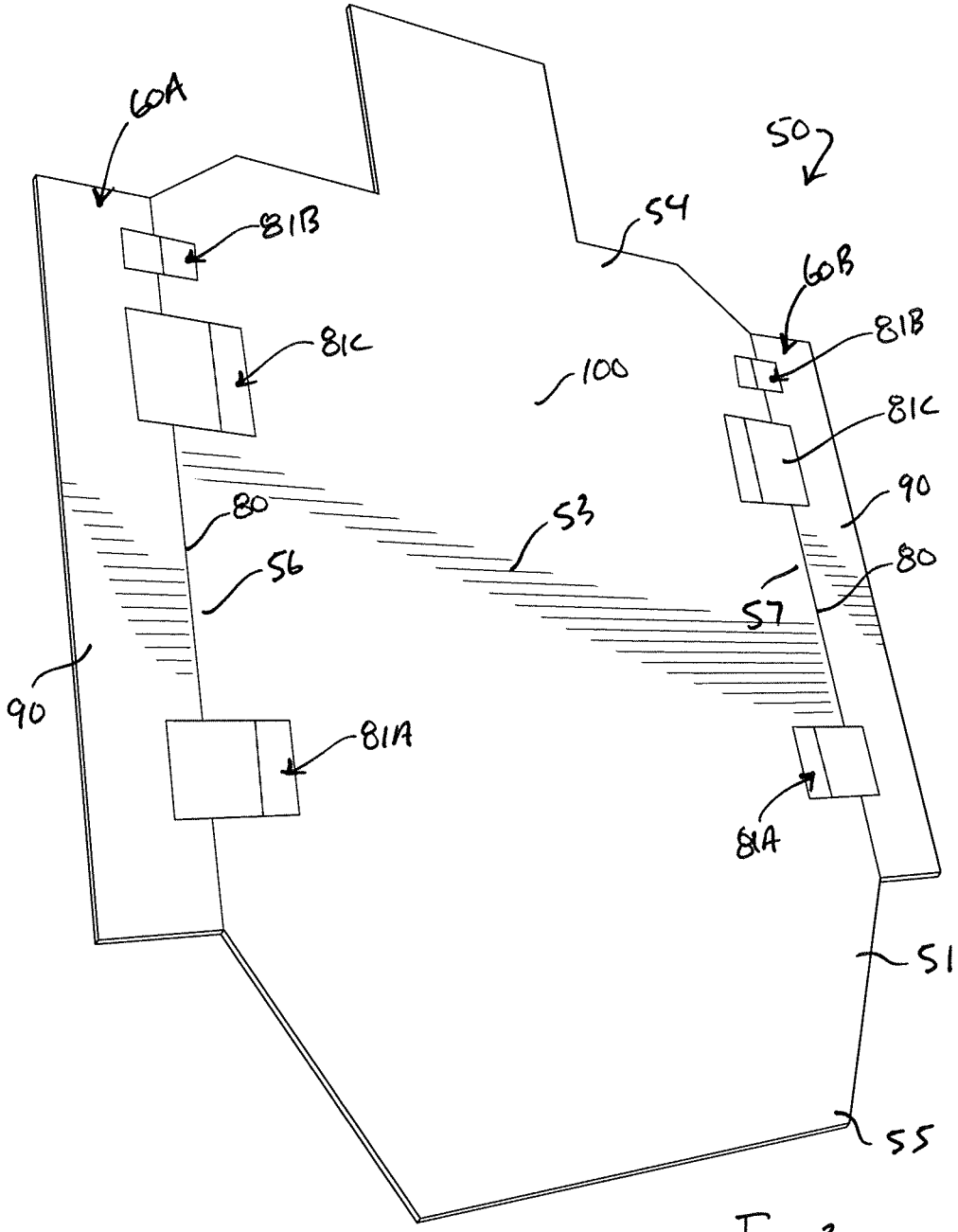
FIG. 3 is a downrange perspective view of the embodiment of FIG. 1.

Turning now to the drawings, in which like reference characters indicate corresponding elements throughout the several views, attention is directed to FIGS. 1-3 illustrating a target 50 constructed and arranged in accordance with the principle of the invention including sheet 51 of a material. Sheet 51 is unitary, being one piece of the chosen material cut and formed to shape, and not separate pieces of the chosen material joined together or adhered together in any suitable manner. The material of sheet 51 is cardboard, a conventional and inherently thin and stiff pasteboard used for signs and boxes. In this example, sheet 51 is a single wall, E flute, corrugated cardboard sheet approximately 1.5 mm thick, which is inherently of thin construction, inherently stiff, and that exhibits inherent excellent crush resistance, as will be readily understood by the person having ordinary skill in the art. Since target 50 includes sheet 51 made of cardboard, target 50 is inexpensive, and inherently lightweight.

Sheet 51 include front or uprange-facing surface 52, rear or downrange-facing surface 53, upper end 54, lower end 55, and opposed sides 56 and 57 each formed with an origami structure 60. In use, target 50 is positioned downrange from an uprange shooting area, in which uprange-facing surface 52 faces uprange toward the uprange shooting area, and downrange-facing surface 53 faces downrange. Because uprange-facing surface 52 faces uprange toward the uprange shooting area and downrange-facing surface 53 faces the opposite direction, i.e. downrange, surface 52 is the uprange-facing surface of target 51 and surface 53 is the downrange-facing surface of target 51.

Each origami structure 60 is a partially cut-out and foldable structure formed in the material, the cardboard, of sheet 51, being foldable from an unfolded condition in FIGS. 1-4 to a folded condition in FIGS. 5-16, wherein each origami structure is collapsed and is flattened, in a direction toward downrange-facing surface 53 of sheet 51, when in the unfolded condition, and is expanded or otherwise deployed to form a sleeve structure 65 deployed and extending rearwardly from downrange-facing surface 53 of sheet 51 and that is adapted to receive a support pole therein for retaining sheet 51 to the support pole, when in the folded condition. Target 50 is unfolded, being in an unfolded condition, a collapsed condition, when origami structures 60 are unfolded being in their unfolded conditions. Target 50 is folded, being in a folded condition, an expanded/deployed condition, when origami structures 60 are folded being in their folded/expanded conditions. In FIGS. 1-3, sheet 51 is flat when sheet 51 is unfolded, i.e., when origami structures 60 are unfolded and flattened. When sheet 51 is flat when sheet 51 is unfolded from being manufactured, sheet 51 is easily transported, and numerous such unfolded sheets can be stacked one atop the other and bound or packaged for easy and convenient transport. In FIGS. 5-8, origami structures 60 are folded, each being in the folded condition forming sleeve structure 65. Sheet 51, including uprange-facing surface 52 and downrange-facing surface 53, is flat between origami structures 60 and between upper end 54 and lower end 55 of sheet 51, when sheet 51 is in its unfolded condition in FIGS. 1-4 and when sheet 51 is in its folded condition in FIGS. 5-16.

In FIGS. 11, 12, 15, and 16, origami structures 60 are folded, each being in the folded condition forming sleeve structure 65, a support pole 70 is inserted into each of sleeve structures 65 to retain sheet 51 thereby on support poles 70, uprange-facing surface 52 is flat between origami structures 60 and between upper end 54 and lower end 55 of sheet 51, and support poles 70 are behind downrange-facing surface 53. When target 50 is installed on support poles 70, support poles 70 are supported upright, such as from a stand or from being staked into the ground, and extend upright to target 50 they support at an elevated location downrange from an uprange shooting area, in which uprange-facing surface 52 faces uprange toward the uprange shooting area, and downrange-facing surface 53 faces downrange. After target 50 positioned downrange is shot from an uprange shooting area a number of times, it may be removed from support poles 70 and replaced with another target constructed and arranged in accordance with the principle of the invention.

Origami structures 60 are identical, each being the mirror image of the other, and are parallel relative to one another when unfolded and when folded. Accordingly, origami structure 60A at side 56 of target 50 will now be discussed in detail, with the understanding that the ensuing discussion of origami structure 60A applies in every respect to origami structure 60B at side 57 of target 50.

Figure 4:
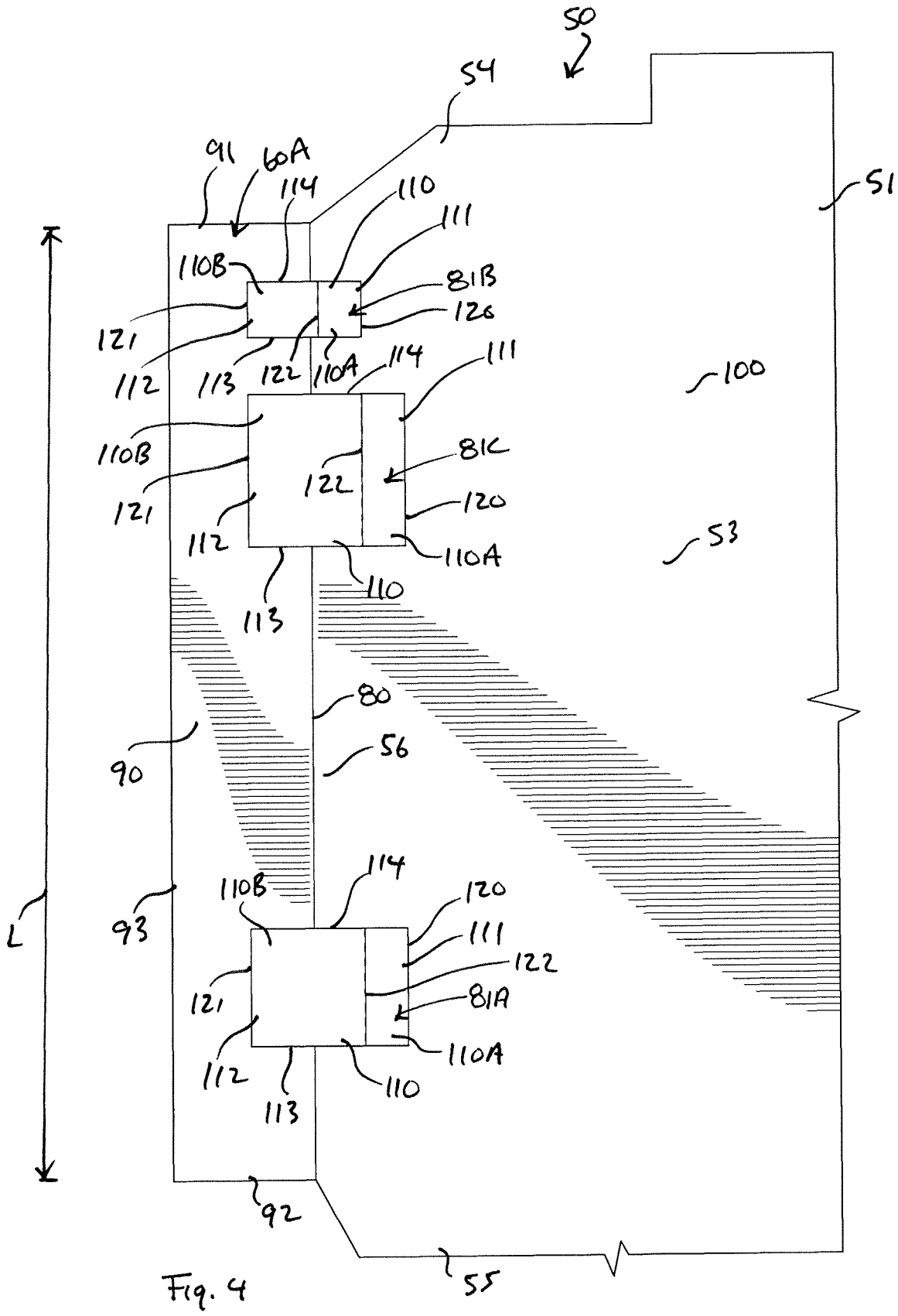
FIG. 4 is an enlarged fragmented view corresponding to FIG. 3.

Referring to FIG. 4, origami structure 60A includes hinge 80, flap section 90, and pop outs 81, all formed in the material of sheet 51. Hinge 80 is a living hinge, known by the skilled person as a thin and/or cut, inherently flexible hinge formed in the material of sheet 51 that exhibits inherently minimal friction and inherently little wear and which is inherently low in cost and easy to form in cardboard, the chosen material of sheet 51. Hinge 80 extends in a direction from lower end 55 of sheet 51 to upper end 54 of sheet 51, divides sheet 51 into outer flap section 90 of sheet 51 and inner center section 100 of sheet 51, and hinges flap section 90 to center section 100. Center section 100 of sheet 51 extends between upper end 54 and lower end 55, and between origami structures 60A and 60B, and is flat, in which uprange-facing surface 52 of center section 100 and downrange-facing surface 53 of center section 100 are parallel relative to each other. Flap section 90 includes upper end 91, lower end 92, outer edge 93 that extends from upper end 91 to lower end 92, and length L from upper end 91 to lower end 92. Hinge 80 extends along length L of flap section 90 from upper end 91 to lower end 92, and flap section 90 extends outwardly from hinge 80 to outer edge 93, that extends along the length of flap section 90 from upper end 91 to lower end 92. Pop outs 81A, 81B, and 81C are spaced apart between upper end 91 of flap section 90 and lower end 92 of flap section 90, are each concurrently formed in flap section 90 and center section 100 on either side of hinge 80, and interrupt hinge 80, wherein hinge 80 is discontinuous.

Figure 5:
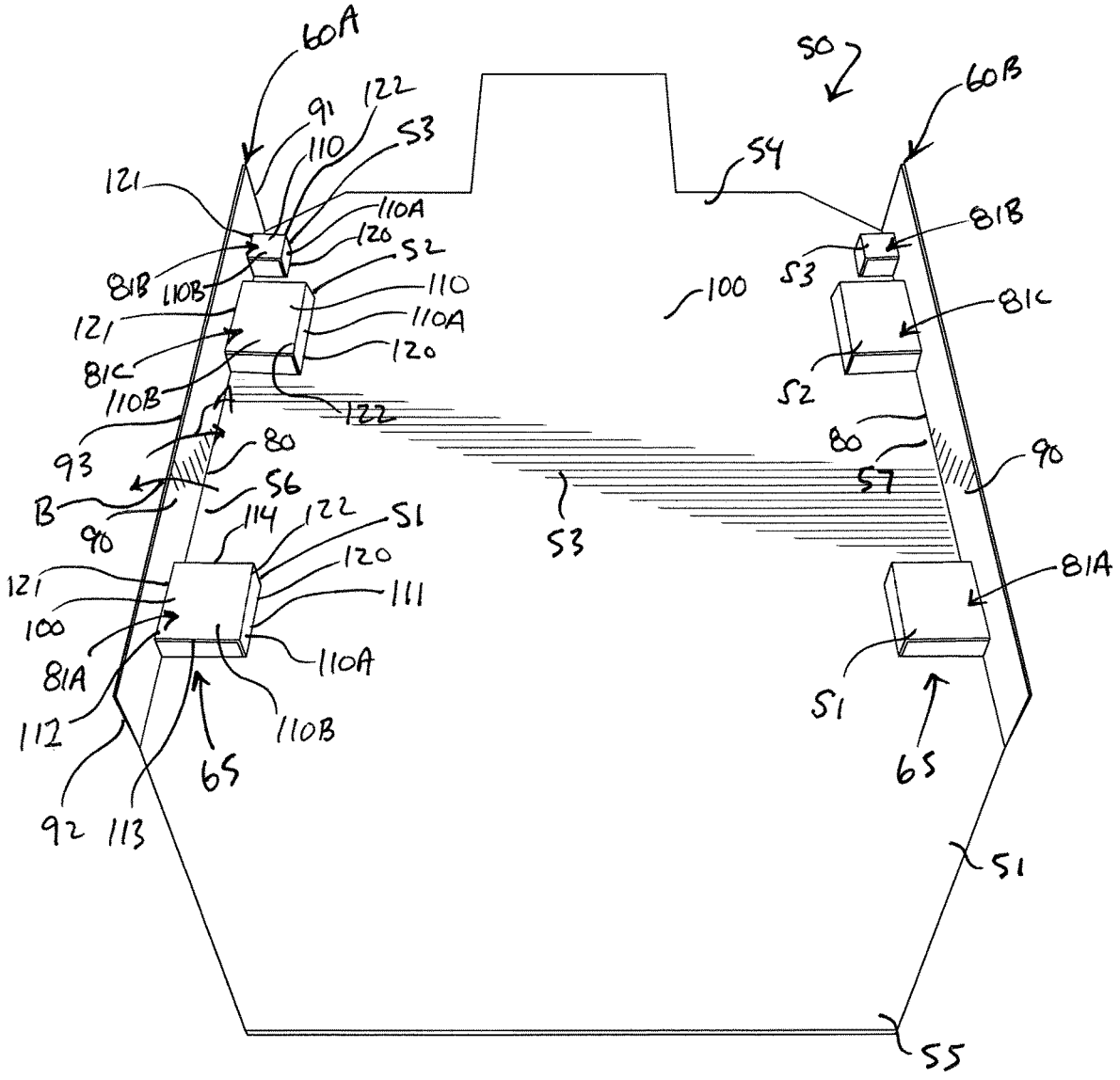
FIGS. 5 and 6 are downrange perspective views of the embodiment of FIG. 1 illustrating the origami structures folded to form sleeve structures.
Figure 6:
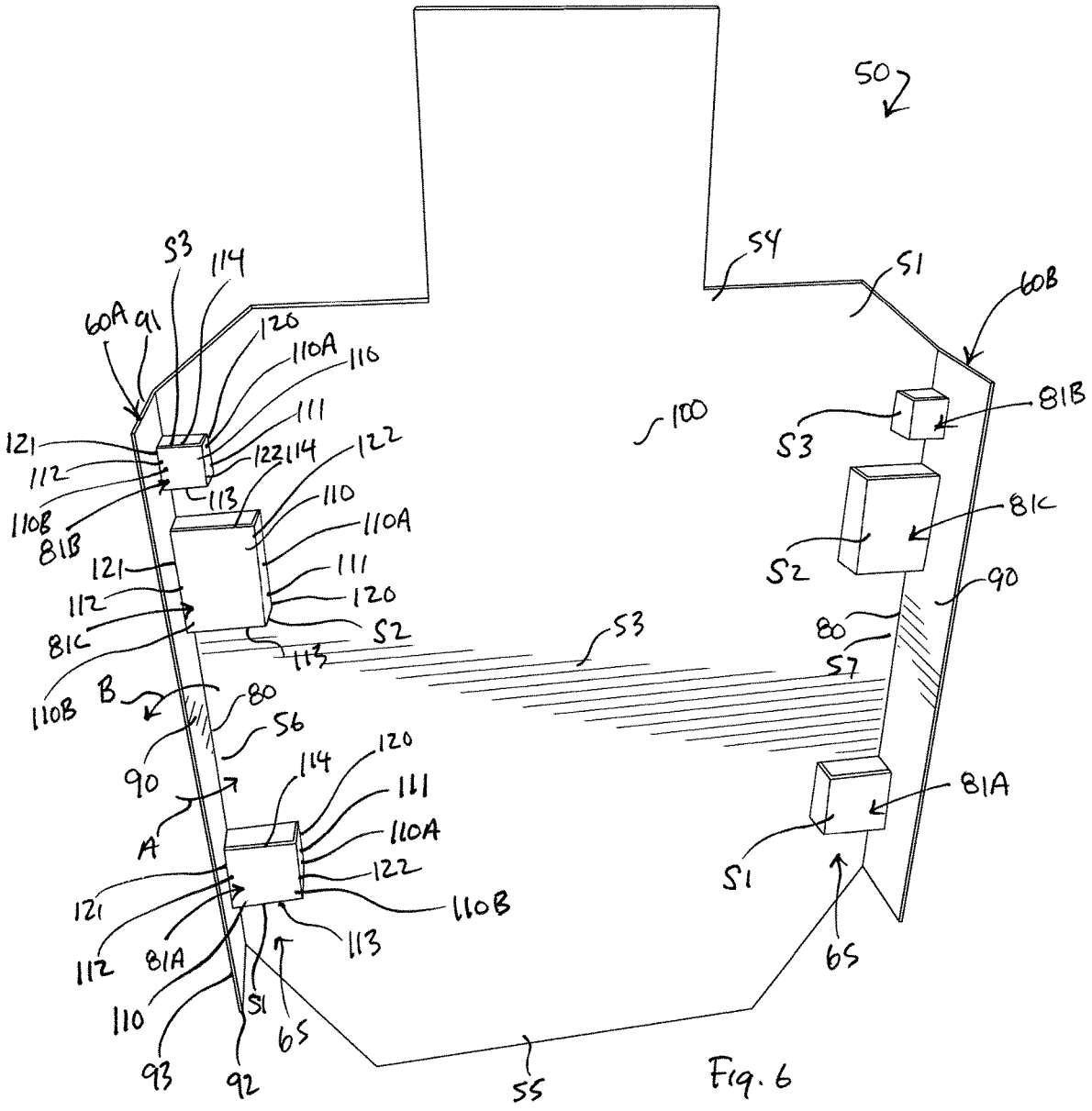
Figure 7:
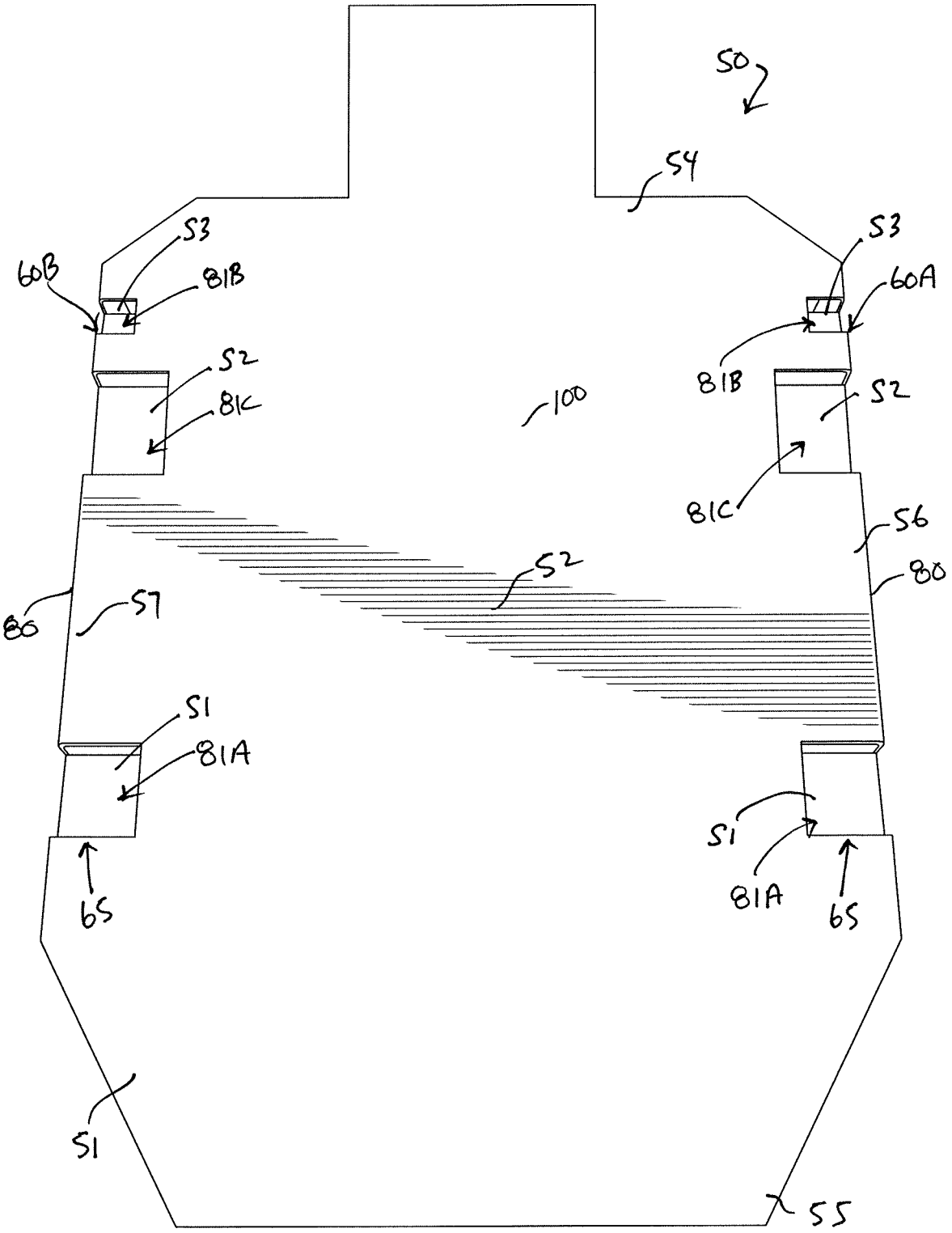
FIGS. 7 and 8 are uprange perspective views of the embodiment of FIGS. 5 and 6.
Figure 8:
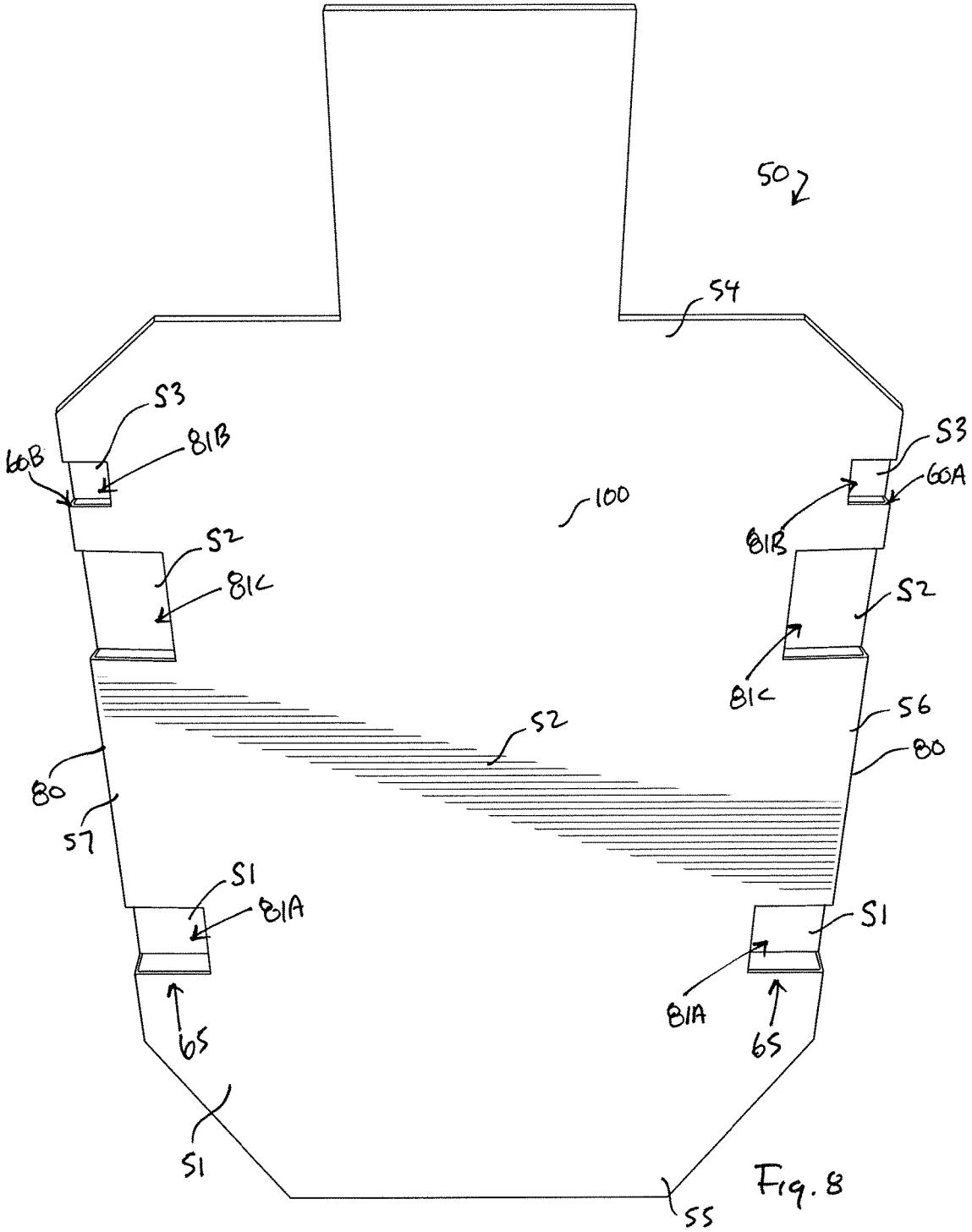

Origami structure 60A is foldable from its unfolded condition in FIGS. 1-4 to its folded condition in FIGS. 5-8. In FIG. 4, flap section 90 is unfolded at and outwardly from hinge 80, and flap section 90, pop outs 81A, 81B, and 81C, and center section 100 are, at the same time, flattened, in a direction toward downrange-facing surface 53 of center section 100, wherein flap section 90, pop outs 81A, 81B, and 81C, and center section are flat, when origami structure 60A is in the unfolded condition. In FIGS. 5 and 6, flap section 90 is folded at hinge 80 inwardly in the direction of arrowed line A toward, and is perpendicular to and extends rearward from, downrange-facing surface 53 of center section 100, pop outs 81A, 81B, and 81C are popped out inwardly from flap section 90 and, at the same time, rearwardly from downrange-facing surface 53 of center section 100 to form sleeves S1 and S2 and a stop S3 that are inline with respect to one another and are spaced apart between upper end 91 of flap section 90 and lower end 92 of flap section 90, when origami structure 60A, the sleeve structure 65, is in the folded condition, in which pop out 81A proximate to lower end 92 forms sleeve S1 that is open on either end, pop out 81C proximate to upper end 91 forms stop S3 formed as a comparatively smaller sleeve that is open on either end, and pop out 81B forms sleeve S2 that is open on either end and sized similarly to the sleeve S1 and that is between sleeve S1 and stop S3 and that is closer to stop S3 than to sleeve S1 in this example. Pop outs 81A and 81B are similarly sized, are larger than pop out 81C, which is considerably smaller than each of pop outs 81A and 81C, and are identical in structure, in which case sleeves S1 and S2 are similarly sized, are larger than stop S3, which is considerably smaller than each of sleeves S1 and S2, and are identical in structure. Accordingly, pop out 81A will now be discussed in detail, with the understanding that the ensuing discussion of pop out 81A applies in every respect to pop outs 81B and 81C.

Pop out 81A includes segment 110 of the material of sheet 51, which is hinged to flap section 90 and to center section 100, and partially cut from sheet 51, being cut along its sides from flap section 90 and center section 100 of sheet 50. Segment 110 includes inner end 111 hinged to center section 100 on the inner side of hinge 80 via inner segment hinge 120 formed in the material of sheet 51, outer end 112 hinged to flap section 90 on the outer side of hinge 80 via outer segment hinge 121 between hinge 80 and outer edge 93 of flap section 90 formed in the material of flap section 90 of sheet 51, opposed parallel first and second sides 113 and 114, which are edges, cut away from the material of center section 100 and flap section 90 of sheet from inner end 111 of segment 110 to outer end 112 of segment 110, and intermediate segment hinge 122 formed in the material of segment 110 of sheet 51. Inner and outer ends 111 and 112 are parallel relative to each other. Hinges 120, 121, and 122 are parallel relative to each other and to hinge 80 and are identical to hinge 80, each being a living hinge formed in the material of sheet 51. Intermediate segment hinge 122 is between inner end 111 of segment 110 and outer end 112 of segment 110, is closer to inner end 111 of segment 110 than to outer end 112 of segment 110, extends from first side 113 of segment 110 to second side 114 of segment 110, and hingedly divides segment 110 into first and second portions 110A and 110B. First portion 110A extends from inner end 111 to intermediate hinge 122. Second portion 110B extends from intermediate hinge 122 to outer end 112.

Segment 110 is flat from its inner end 111 to its outer end 112, from inner segment hinge 120 at center section 100 to outer segment hinge 121 at flap section 90, and resides in the inherent area of sheet 51 from which segment 110 is partially cut away from, when flap section 120 is unfolded outwardly from hinge 80 in FIG. 4 when origami structure 60A is unfolded. When flap section 90 is folded inwardly in the direction of arrowed line A in FIGS. 5 and 6 from its unfolded condition in FIGS. 1-4 to its folded condition in FIGS. 5 and 6, at the same time segment 110 pops out of the inherent area of sheet 51 from which segment 110 is partially cut away from and deploys, and hingedly articulates, inwardly from flap section 90 and rearwardly from downrange-facing surface 53 of center section 110 to form sleeve S1, in which first portion 110A folds at inner segment hinge 120 rearwardly from downrange-facing surface 53 of center section 100, second portion 110 folds at outer segment hinge 121 inwardly from flap section 90, and first portion 110A and second portion 110B fold at intermediate segment hinge 122 inwardly toward one another rearwardly from downrange-facing surface 53 of center section 100 and inwardly from flap section 90, respectively, when origami structure 60A is folded from its unfolded condition to its folded condition. Accordingly, first portion 110A is folded at inner segment hinge 120 rearwardly from downrange-facing surface 53 of center section 100 and is perpendicular relative to downrange-facing surface 53, second portion 110B is folded at outer segment hinge 121 inwardly from flap section 90 and is perpendicular relative to flap section 90 and to first portion 110A and is perpendicular relative to downrange-facing surface 53, and first portion 110A and second portion 110B are folded orthogonally at intermediate segment hinge 122 inwardly toward one another rearwardly from downrange-facing surface 53 of center section 100 and inwardly from flap section 90, respectively, to form sleeve S1, when origami structure 60A is in the folded condition.

Origami structure 60A is folded from its unfolded condition, its collapsed condition, to its folded condition, its expanded condition, by hand. When origami structure 60A is folded from its unfolded condition to its folded condition, the concurrent folding of flap section 90 and pop outs 81A, 81B, and 81C, which hingedly articulate at hinges 120, 121, and 122 from their unfolded conditions to their folded conditions, can be coaxed by hand. To unfold origami structure 60A from its folded condition to its unfolded condition, the described operation of folding origami structure 60A from its folded condition to its unfolded condition need only be reversed, in which pop outs 81A, 81B, and 81C automatically hingedly articulate at hinges 120, 121, and 122 and elongate between flap section 90 and center section 100 to resume their unfolded conditions in the inherent areas of sheet 51 from which pop outs 81A, 81B, and 81C are partially cut away from, when flap section 120 is unfolded outwardly from hinge 80 in FIGS. 1-4 when origami structure 60A is unfolded, in which the unfolding of pop outs 81A, 81B, and 81C from their folded conditions to their unfolded conditions can be coaxed by hand when flap section 90 is folded outwardly in the direction of arrowed line B in FIGS. 5 and 6 from its folded condition to its unfolded condition in FIGS. 1-4.

Figure 9:
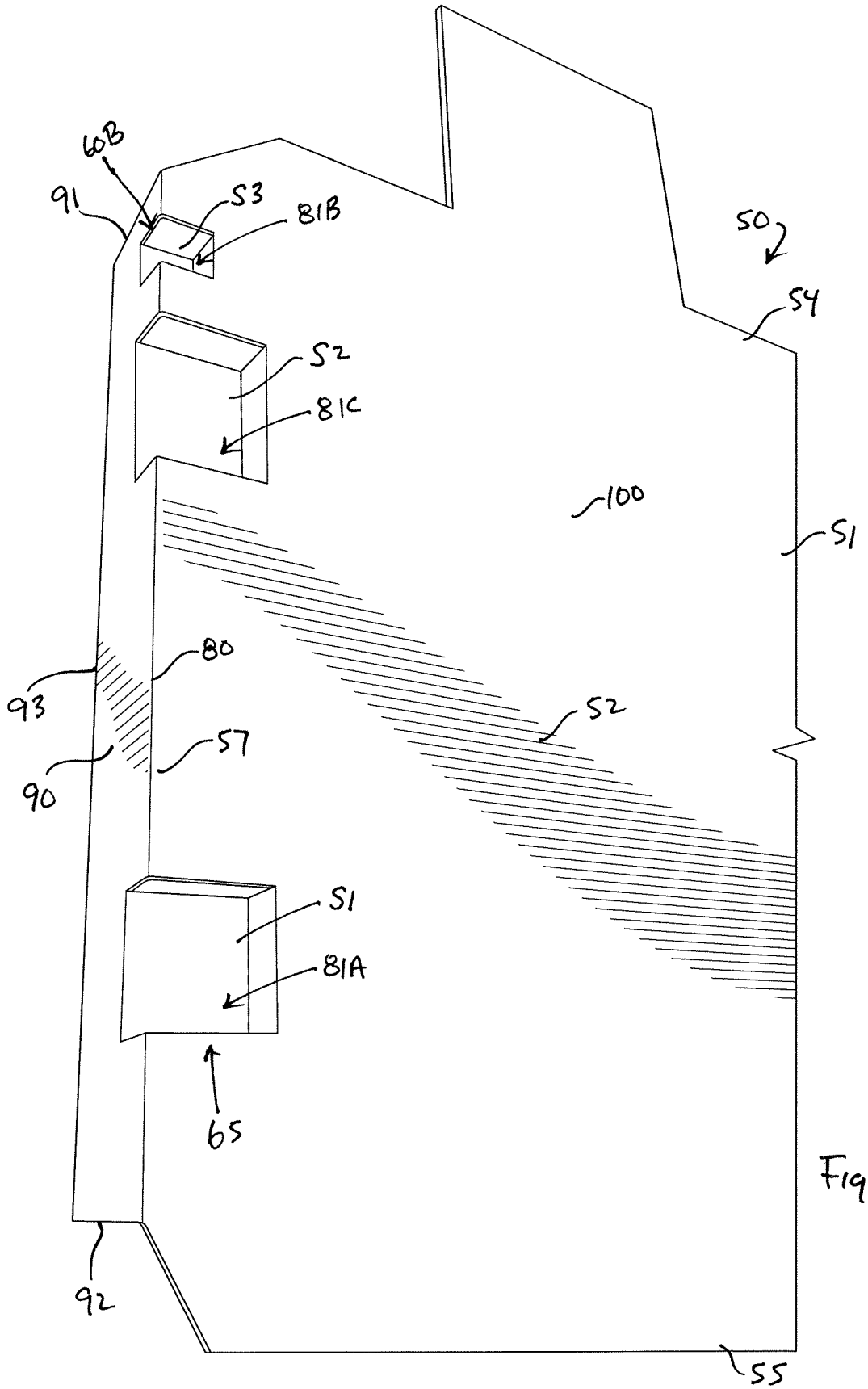
FIGS. 9 and 10 are enlarged uprange fragmented views corresponding to FIGS. 7 and 8.
Figure 10:
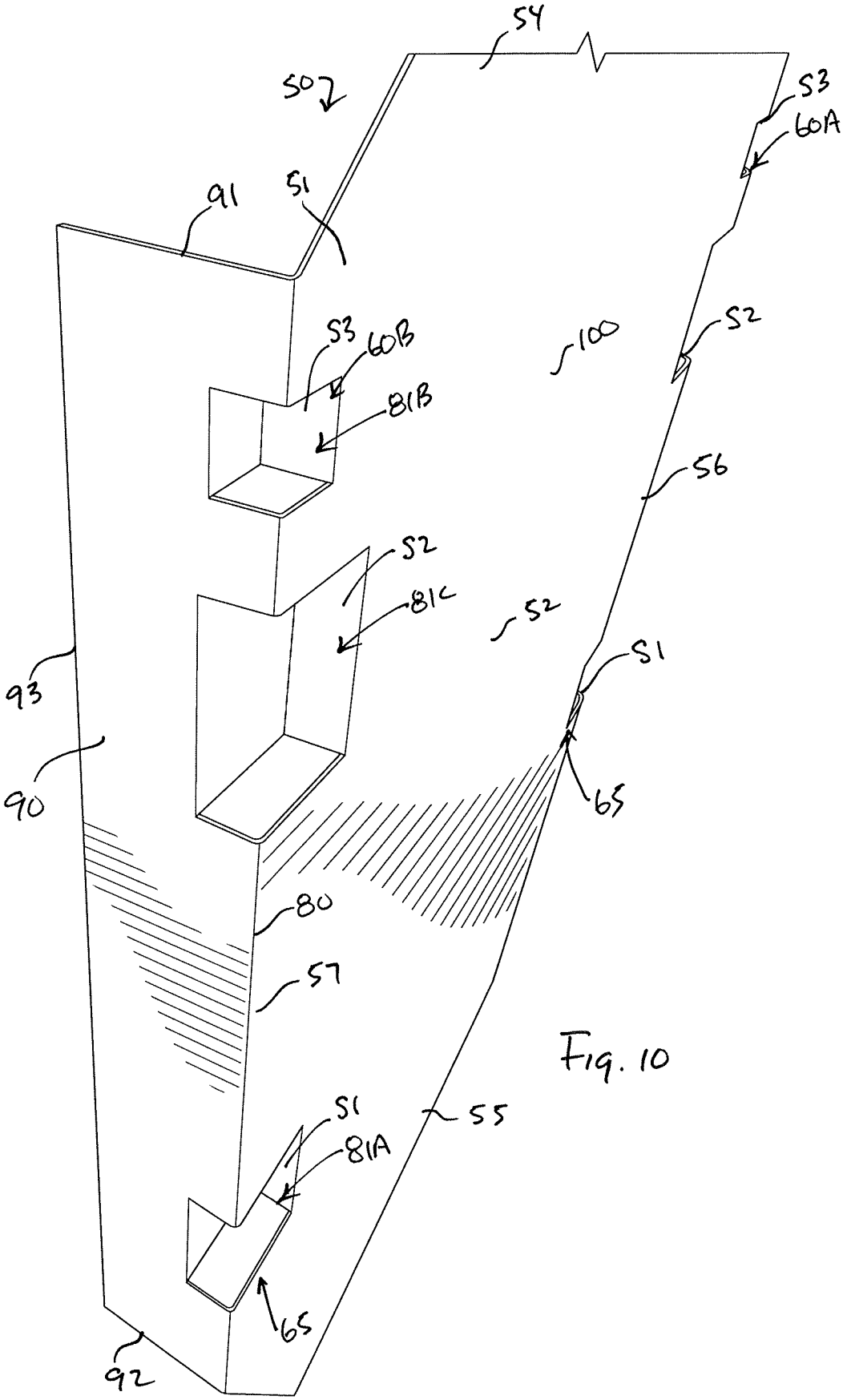

In FIGS. 5-10, origami structures 60A and 60B are each folded, each being in the folded condition, in which pop outs 81A, 81C, and 81B of each origami structure 60A and 60B form sleeve structure 65, inline sleeves S1 and S2 and stop S3, respectively. FIGS. 9 and 10 are uprange fragmentary views of target 50 illustrating origami structure 60B as it would appear in its folded condition. As described previously, center section 100 of sheet 51 extends between upper end 54 and lower end 55, and between origami structures 60A and 60B, and is flat, in which uprange-facing surface 52 of center section 100 and downrange-facing surface 53 of center section 100 are parallel relative to each other. This condition applies when origami structures 60A and 60B are in their unfolded conditions in FIGS. 1-3, and when origami structures 60A and 60B are in their folded conditions in FIGS. 7 and 8.

Figure 11:
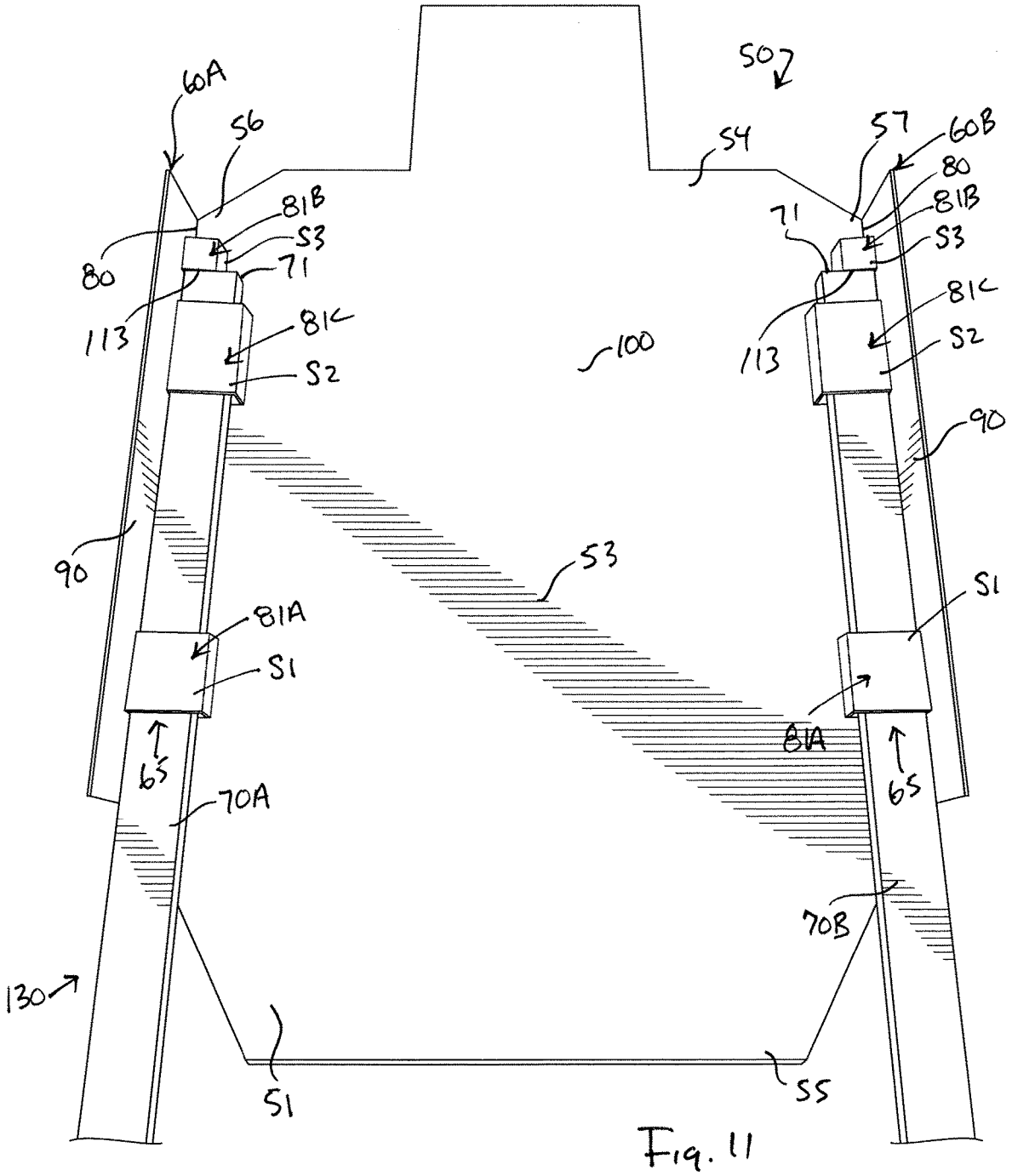
FIGS. 11 and 12 are downrange perspective views corresponding to FIGS. 5 and 6 illustrating a support pole inserted into each of the sleeve structures.
Figure 12:
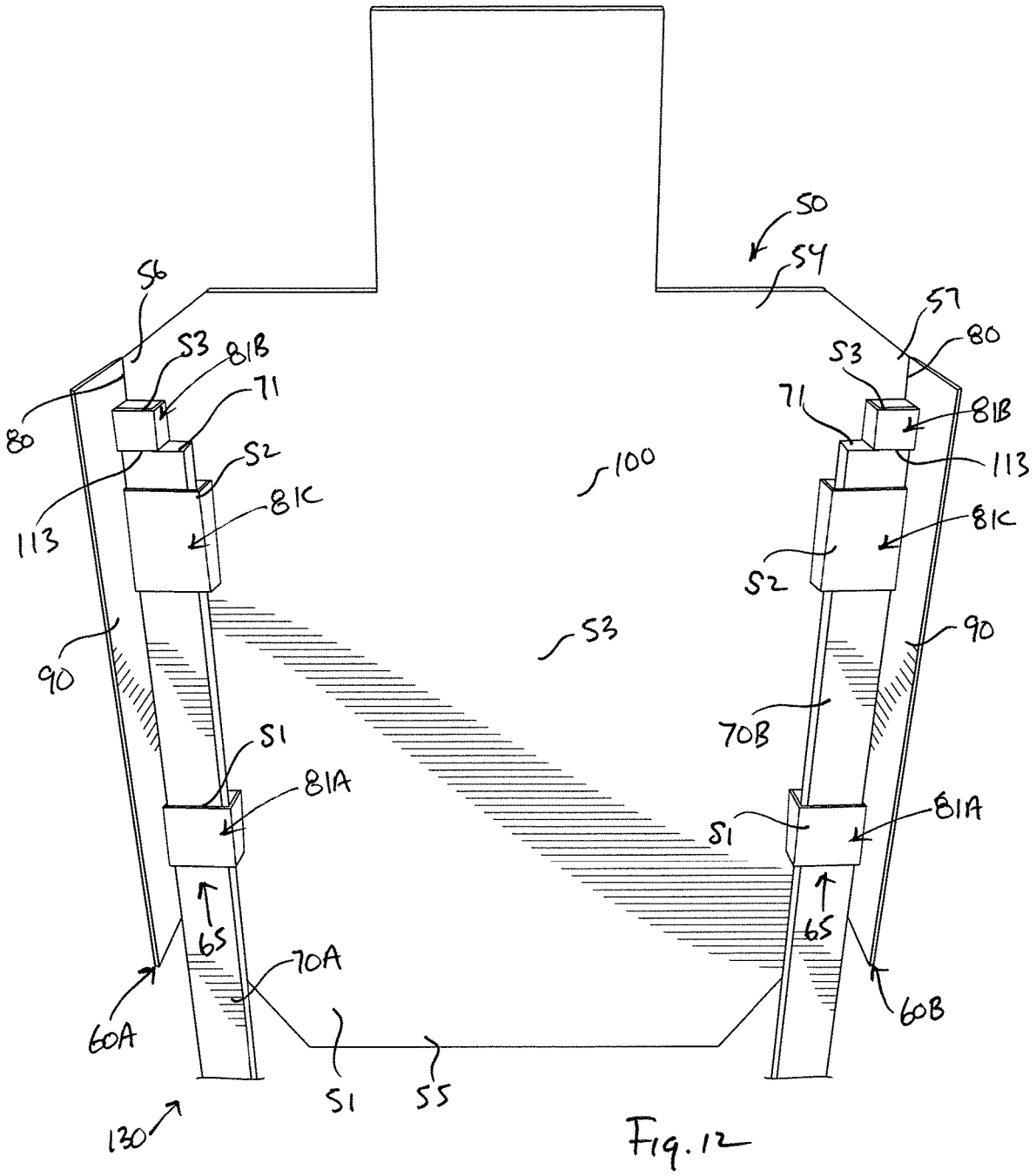
Figure 13:
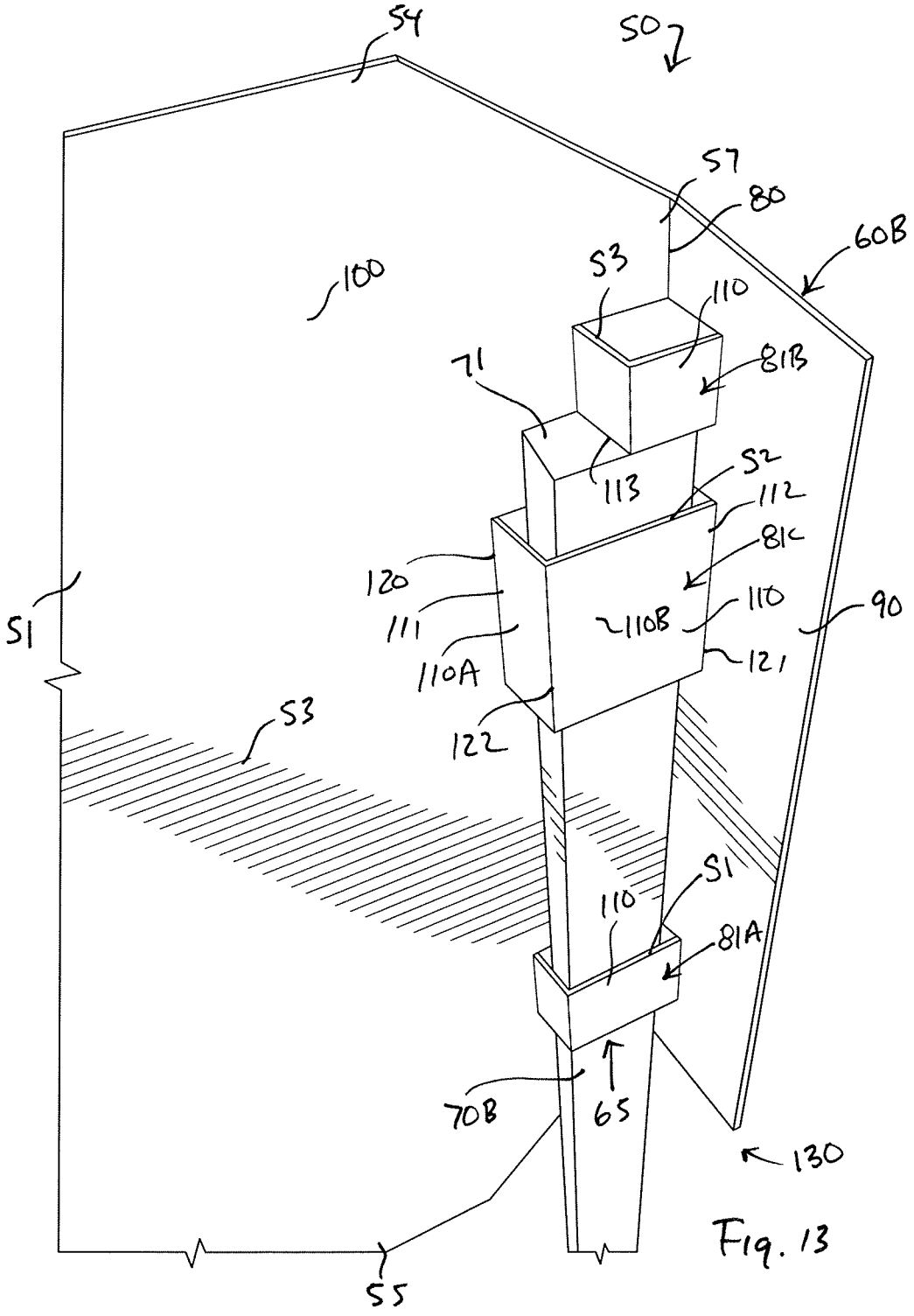
FIG. 13 is an enlarged downrange fragmented view corresponding to FIGS. 11 and 12.
Figure 14:
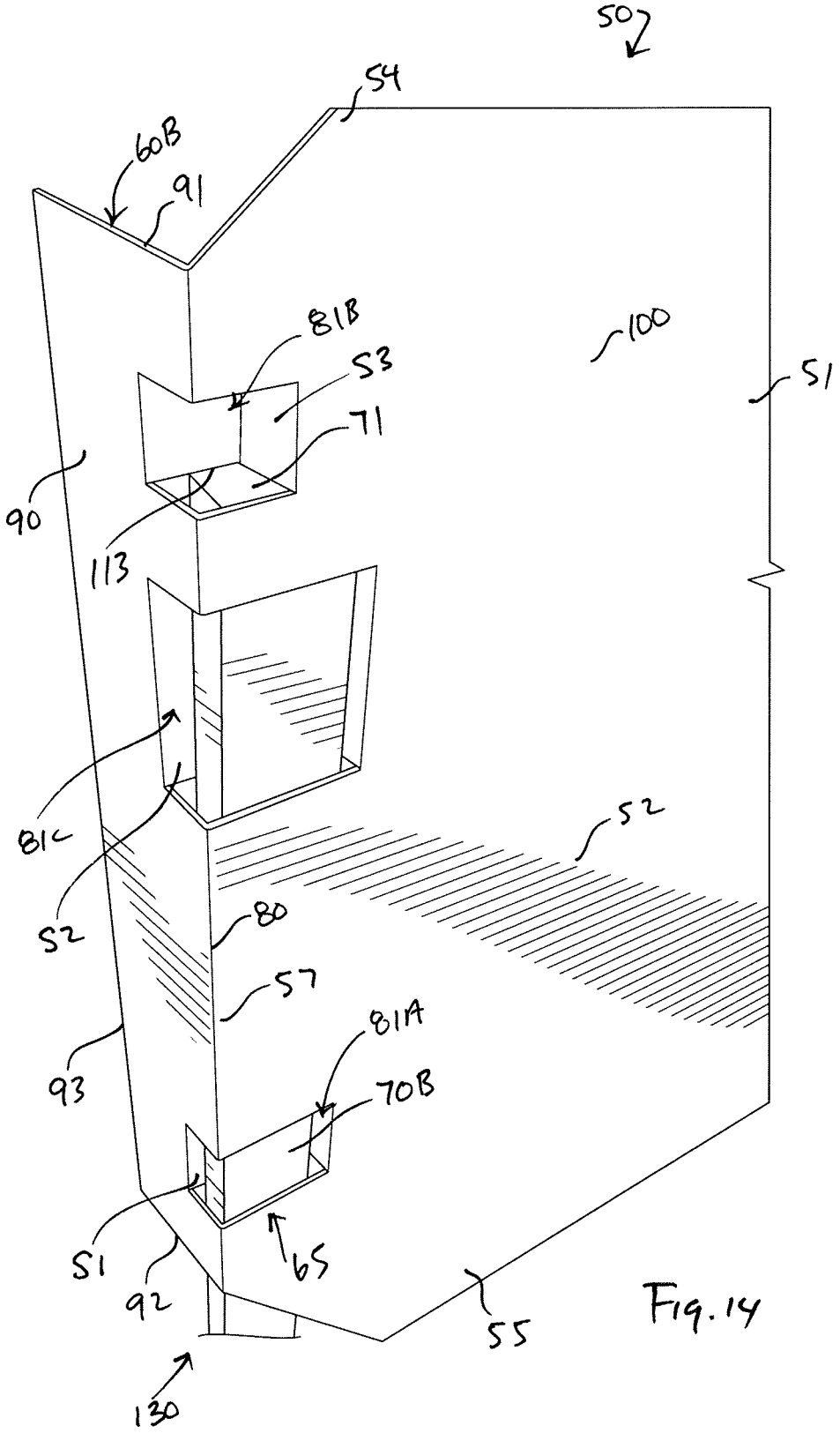
FIG. 14 is an uprange perspective view of the embodiment of FIG. 13.
Figure 15:
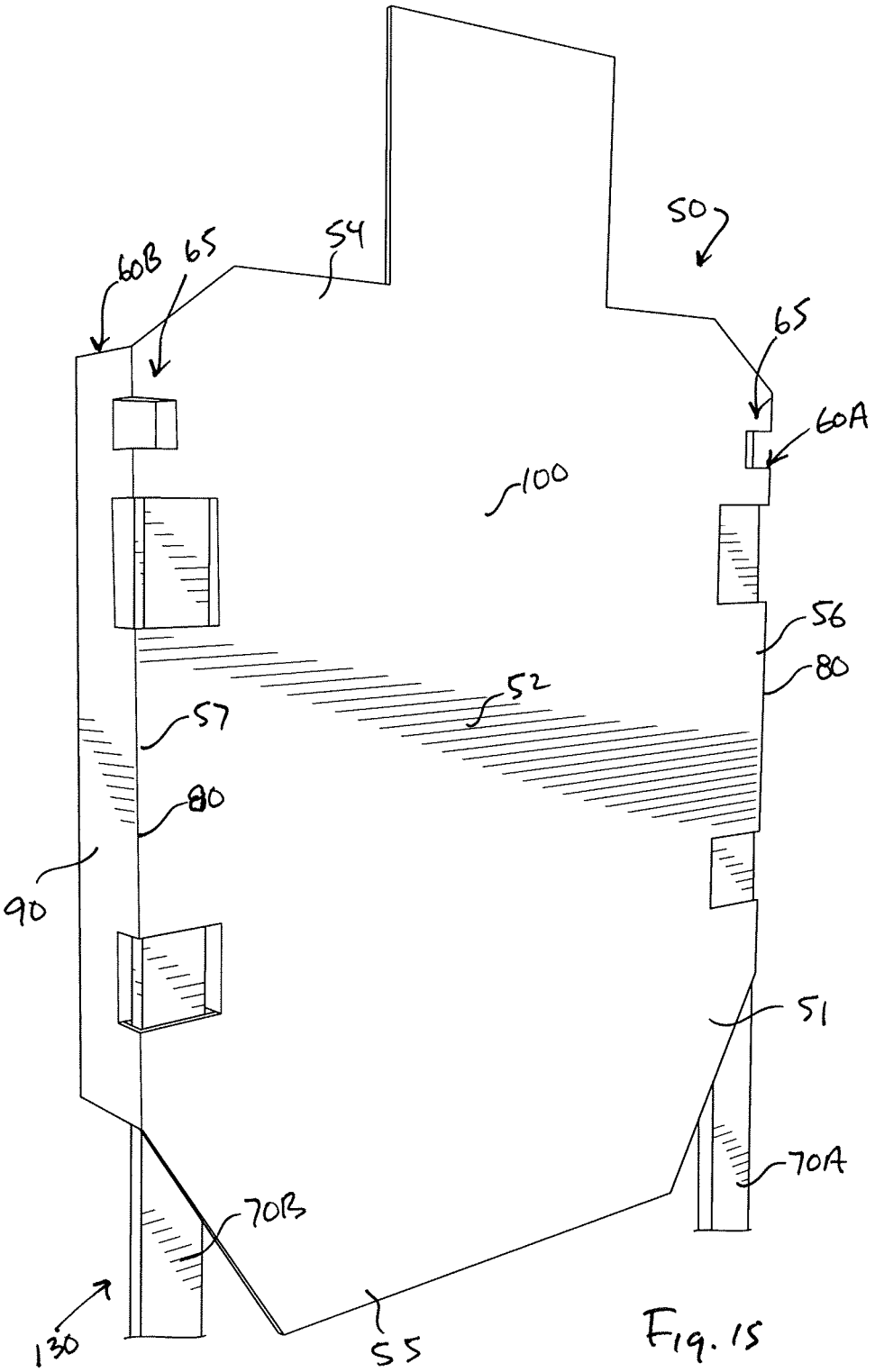
FIG. 15 is an uprange perspective view of the embodiment of FIGS. 11 and 12.
Figure 16:
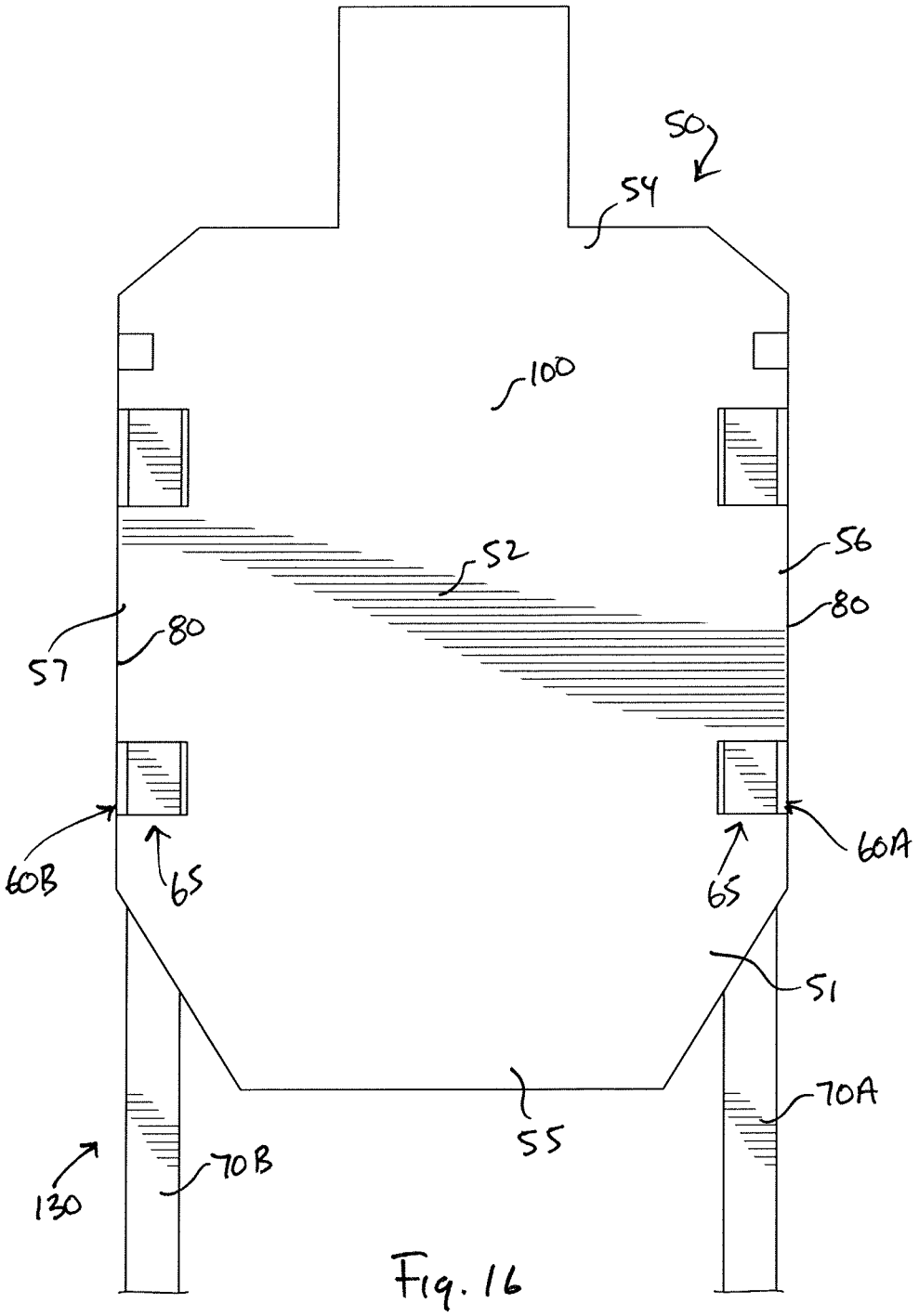
FIG. 16 is an uprange elevation view of the embodiment of FIG. 15.

Origami structures 60A and 60B are each disabled from receiving a support pole, when origami structures 60A and 60B are flattened when they are in their unfolded conditions, their collapsed conditions. Origami structures 60A and 60B are each enabled for receiving a support pole for retaining target 50 thereby to the support poles, when origami structures 60A and 60B are deployed when they are in their folded conditions, their expanded conditions. In FIGS. 11 and 12, target 50 is folded, being in its folded condition, in which origami structures 60A and 60B are folded being in their deployed folded conditions, forming sleeve opposed structures 65 in the respective sides 56 and 57 of sheet 51. Support poles 70A and 70B are inserted their upper ends 71 first in a direction from lower end 55 of sheet 51 to upper end 54 of sheet 51 sequentially into and through sleeves S1 and S2 formed by the respective pop outs 81A and 81C of the sleeve structures 65 of the respective origami structures 60A and 60B until their upper ends 71 directly contact/engage sides 113, respectively, which are edges, of stops S3 formed by the respective pop outs 81B, to retain sheet 51 thereby on support poles 70 to form target assembly 130. Target 50 is retained releasably to support poles 70A and 70B when target 50 is in its unfolded/expanded condition and when support poles 70A and 70B are inserted through sleeves S1 and S2 of the respective origami structures 60A and 60B and the ends 71 of support poles 70A and 70B are, at the same time, received in direct contact against sides 113 of the respective stops S3. FIG. 13 is an enlarged, fragmented, downrange perspective view illustrating support pole 70B inserted into sleeve structure 65 of origami structure 60B, and FIG. 14 is an enlarged, fragmented, uprange perspective view illustrating support pole 70B inserted into sleeve structure 65 of origami structure 60B. When target 50 is installed on support poles 70 to form target assembly 130 in FIGS. 11, 12, 15, and 16, the lower ends of support poles 70 are supported upright, such as from a stand or from being staked into the ground, and extend upright to target 50 they support at an elevated location downrange from an uprange shooting area, in which uprange-facing surface 52 faces uprange toward the uprange shooting area, and downrange-facing surface 53 faces downrange. In target assembly 130 in FIGS. 15 and 16, uprange-facing surface 52 is flat between origami structures 60A and 60B and, more particularly, between hinges 80 of the respective origami structures 60A and 60B, and between upper end 54 and lower end 55 of sheet 51, and the support poles are behind center section 100 proximate to either side 56 and 57 of target 50 behind downrange-facing surface 53 of center section 100 as illustrated in FIGS. 11 and 12, in which uprange-facing surface 52 facing uprange toward an uprange shooting area provides a flat target area for shooting at in target shooting, according to the principle of the invention. To remove target 50 from support poles 70A and 70B, the foregoing operation for installing target 50 onto support poles 70A and 70B need only be reversed for withdrawing support poles 70A and 70B from the sleeve structures of the respective origami structures 60A and 60B.

Target 50 is useful in that it is easy to construct, inexpensive, easy to adjust by hand from its unfolded condition to its folded condition, and is easily mounted to support poles by hand to form a useful target assembly 130 when target 50 is in its folded condition. After target 50 positioned downrange is shot from an uprange shooting area a number of times, it may be removed and replaced with another target constructed and arranged in accordance with the principle of the invention.

II

Figure 17:
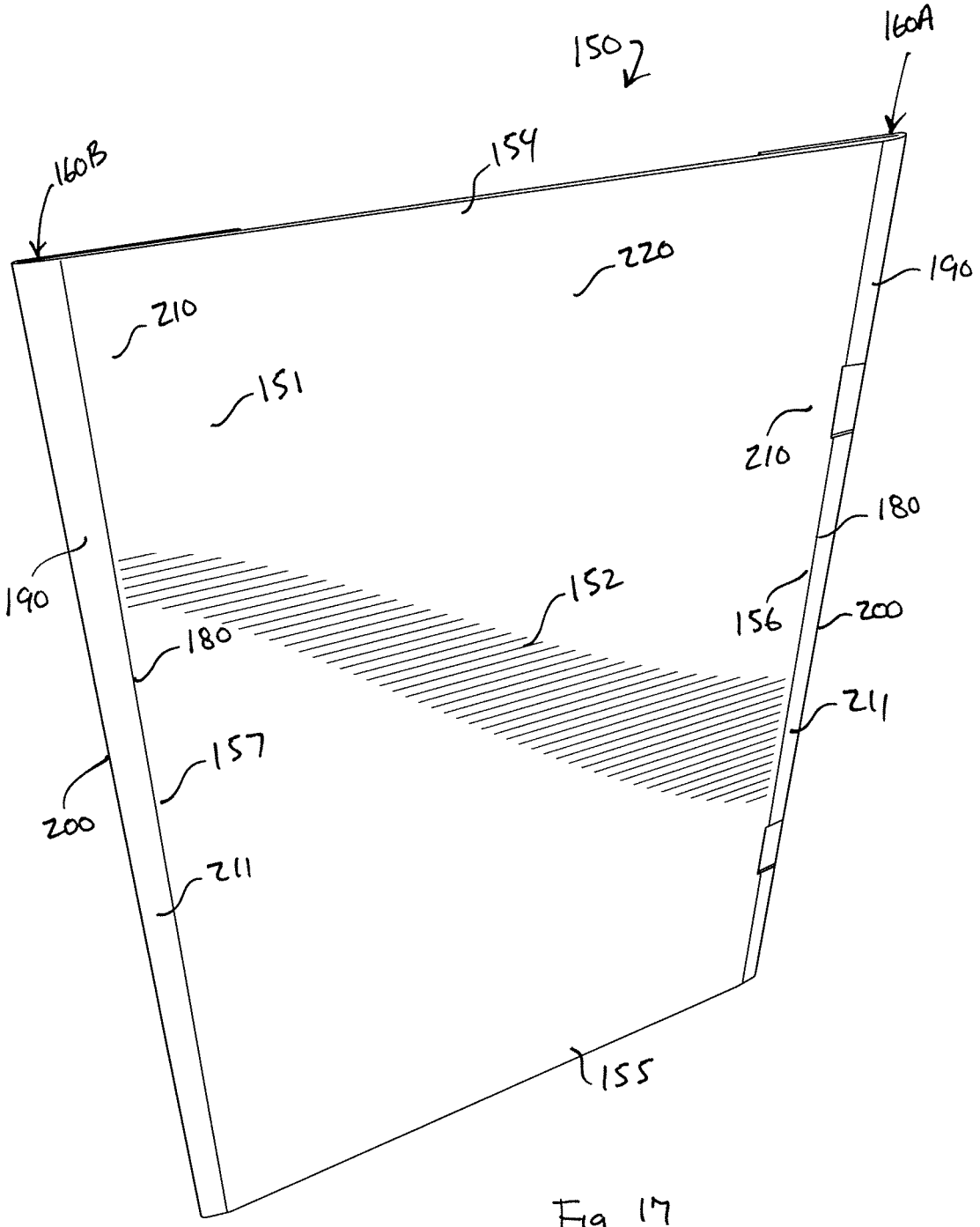
FIG. 17 is an uprange perspective view of a target constructed and arranged in accordance with an alternate embodiment of the invention.
Figure 18:
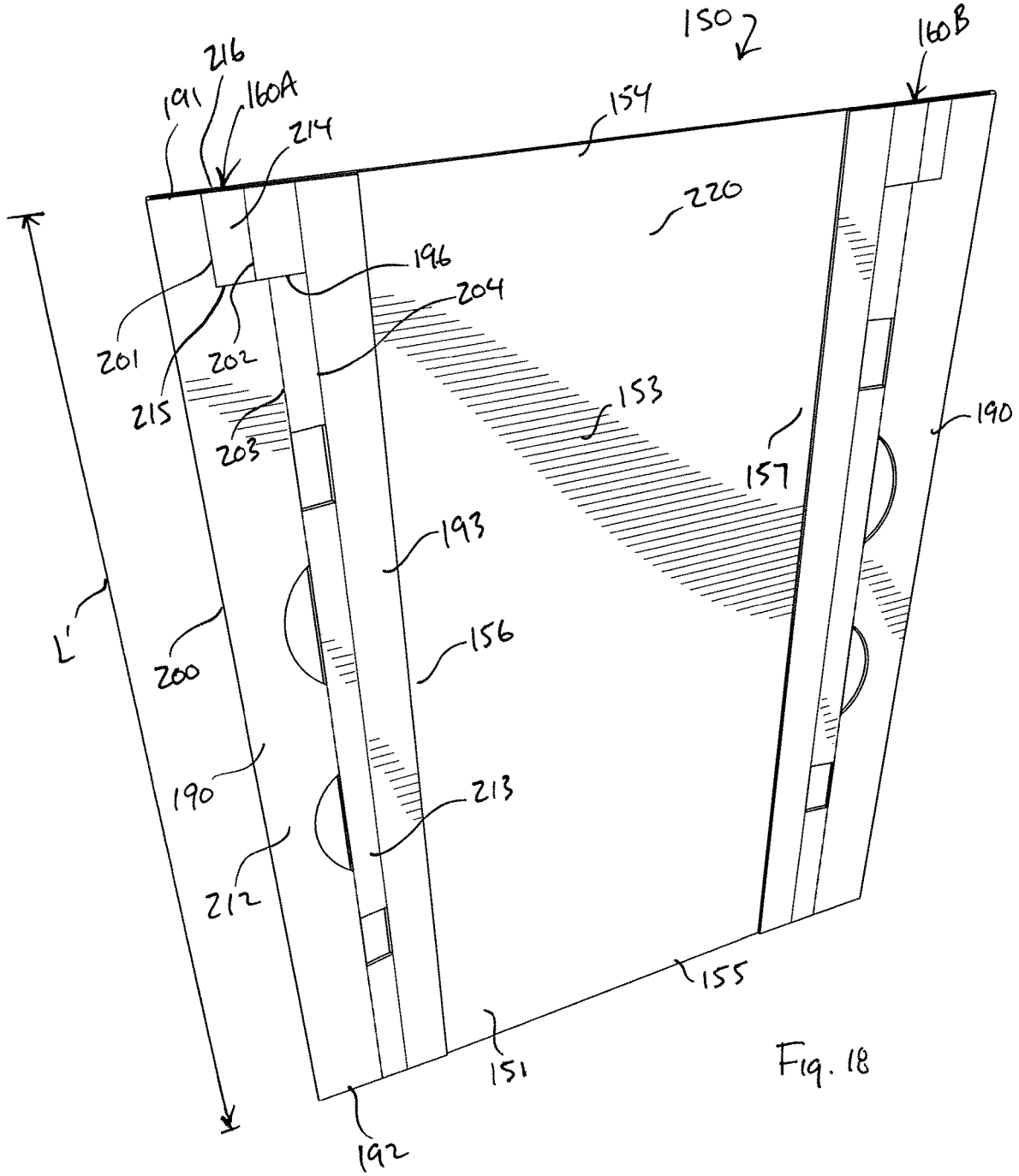
FIG. 18 is a downrange perspective view of the embodiment of FIG. 17.

Reference is now directed to FIGS. 17 and 18 illustrating another embodiment of a target 150 constructed and arranged in accordance with the principle of the invention including sheet 151 of a material. Sheet 151 is unitary, being one piece of the chosen material cut to shape, and not separate pieces of the chosen material joined together or adhered together in any suitable manner. The material of sheet 151 is cardboard, a conventional and inherently thin and stiff pasteboard used for signs and boxes. In this example, sheet 151 is a single wall, E flute, corrugated cardboard sheet approximately 1.5 mm thick, which, as described above in the embodiment denoted at 50, is inherently of thin construction, inherently stiff, and that exhibits inherent excellent crush resistance. Since target 150 includes sheet 151 made of cardboard, target 150 is, like target 50, inexpensive, and inherently lightweight.

Sheet 151 include front or uprange-facing surface 152, rear or downrange-facing surface 153, upper end 154, lower end 155, and opposed sides 156 and 157 each formed with a hinged sleeve 160. In use, target 150 is positioned downrange from an uprange shooting area, in which uprange-facing surface 152 faces uprange toward the uprange shooting area, and downrange-facing surface 153 faces downrange. Because uprange-facing surface 152 faces uprange toward the uprange shooting area and downrange-facing surface 153 faces the opposite direction, i.e. downrange, surface 152 is the uprange-facing surface of target 151 and surface 153 is the downrange-facing surface of target 151.

Figure 19:
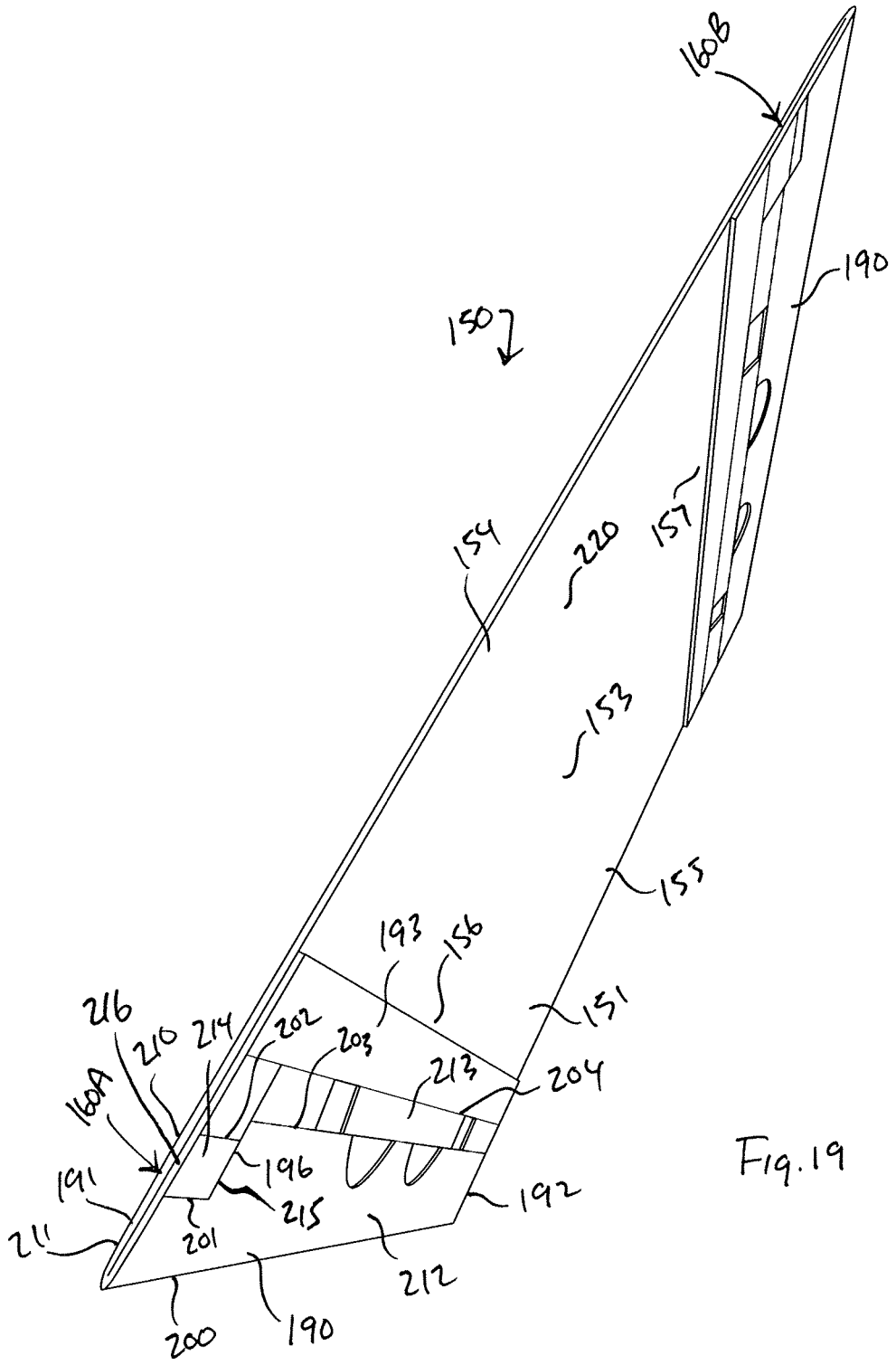
FIG. 19 is a top downrange perspective view of the embodiment of FIG. 17.
Figure 20:
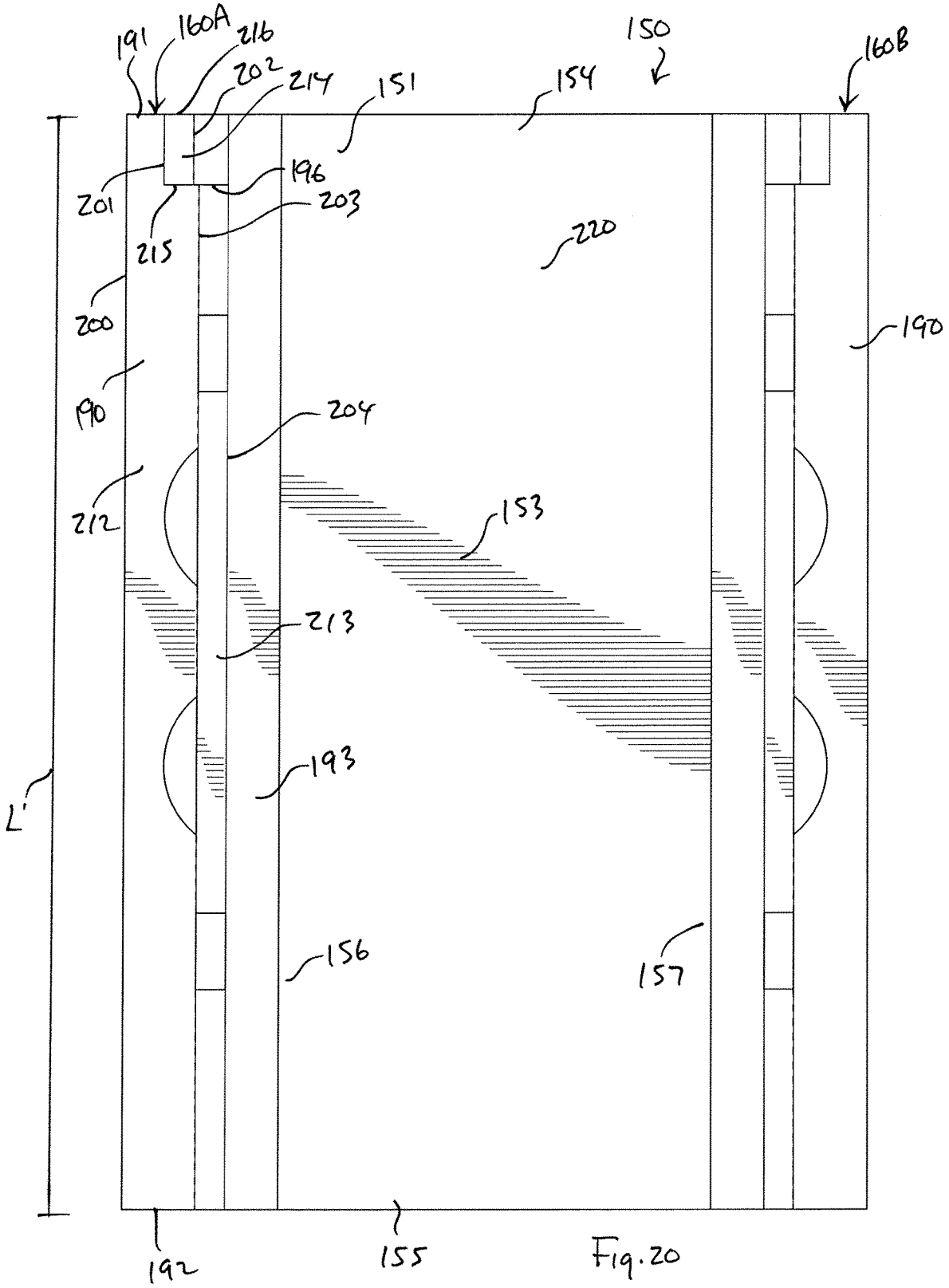
FIG. 20 is a downrange elevation view of the embodiment of FIG. 17.
Figure 21:
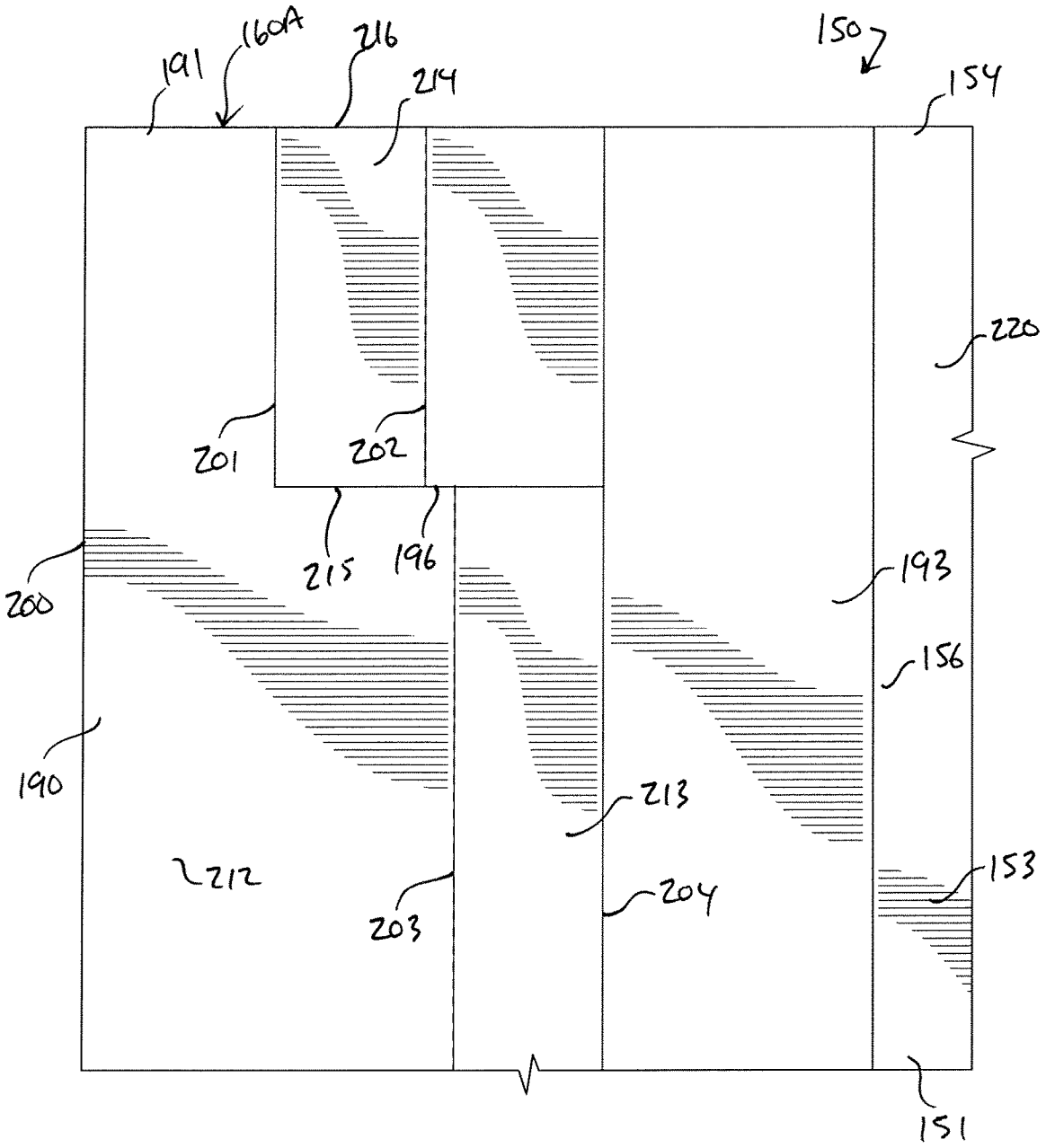
FIG. 21 is an enlarged fragmented view corresponding to FIG. 20.
Figure 22:
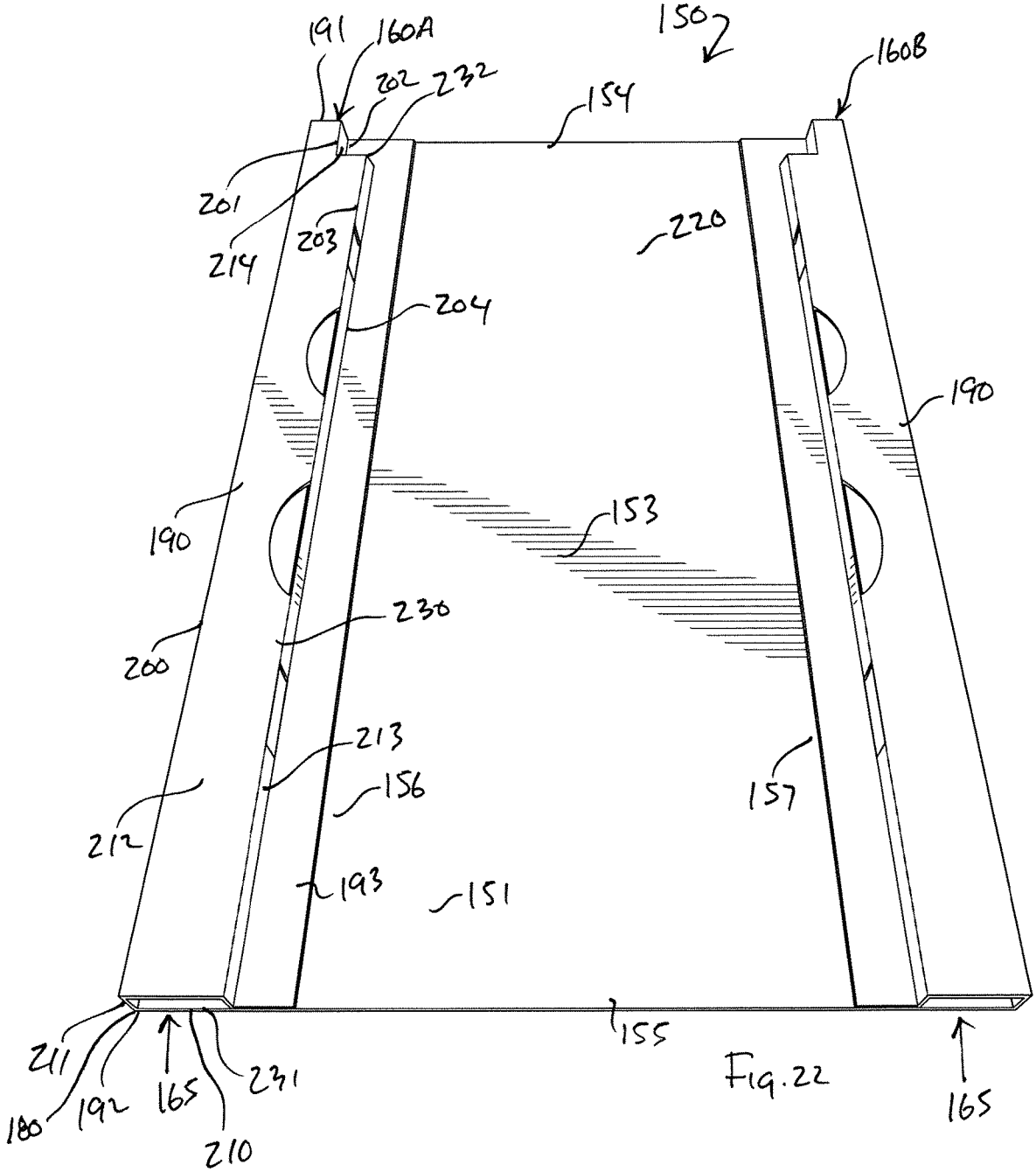
FIGS. 22-25 are downrange perspective views of the embodiment of FIG. 17 illustrating the origami structures folded to form sleeve structures.

Each hinged sleeve 160 is an origami structure, a partially cut-out and foldable structure formed in the material, the cardboard, of sheet 151, being foldable from an unfolded condition in FIGS. 17-20, a collapsed condition, to a folded condition, an expanded condition, in FIGS. 22-26, wherein each hinged sleeve 160 is collapsed and is flattened in a direction toward downrange-facing surface 153 of sheet 151, when in the unfolded condition, and is expanded or otherwise deployed to form a sleeve structure 165 deployed and extending rearwardly from downrange-facing surface 153 of sheet 151 that is adapted to receive a support pole therein for retaining sheet 151 to the support pole, when in the folded condition. Target 150 is unfolded, being in an unfolded condition, an expanded condition, when hinged sleeves 160 are unfolded being in their unfolded conditions. Target 150 is folded, being in a folded condition, a collapsed condition, when hinged sleeves 160 are folded being in their folded conditions. In FIGS. 17-19, sheet 151 is flat when sheet 151 is unfolded, i.e., when hinged sleeves 160 are unfolded. When sheet 151 is flat when sheet 151 is unfolded, sheet 151 is easily transported, and numerous such unfolded sheets can be stacked one atop the other and bound or packaged for easy and convenient transport. In FIGS. 22-26, hinged sleeves 160 are folded, each being in the folded condition forming sleeve structure 165. Sheet 151, including uprange-facing surface 152 and downrange-facing surface 153, is flat between hinged sleeves 160 and between upper end 154 and lower end 155 of sheet 151, when sheet 151 is in its unfolded condition in FIGS. 1-3 and when sheet 151 is in its folded condition in FIGS. 22-26.

Figure 27:
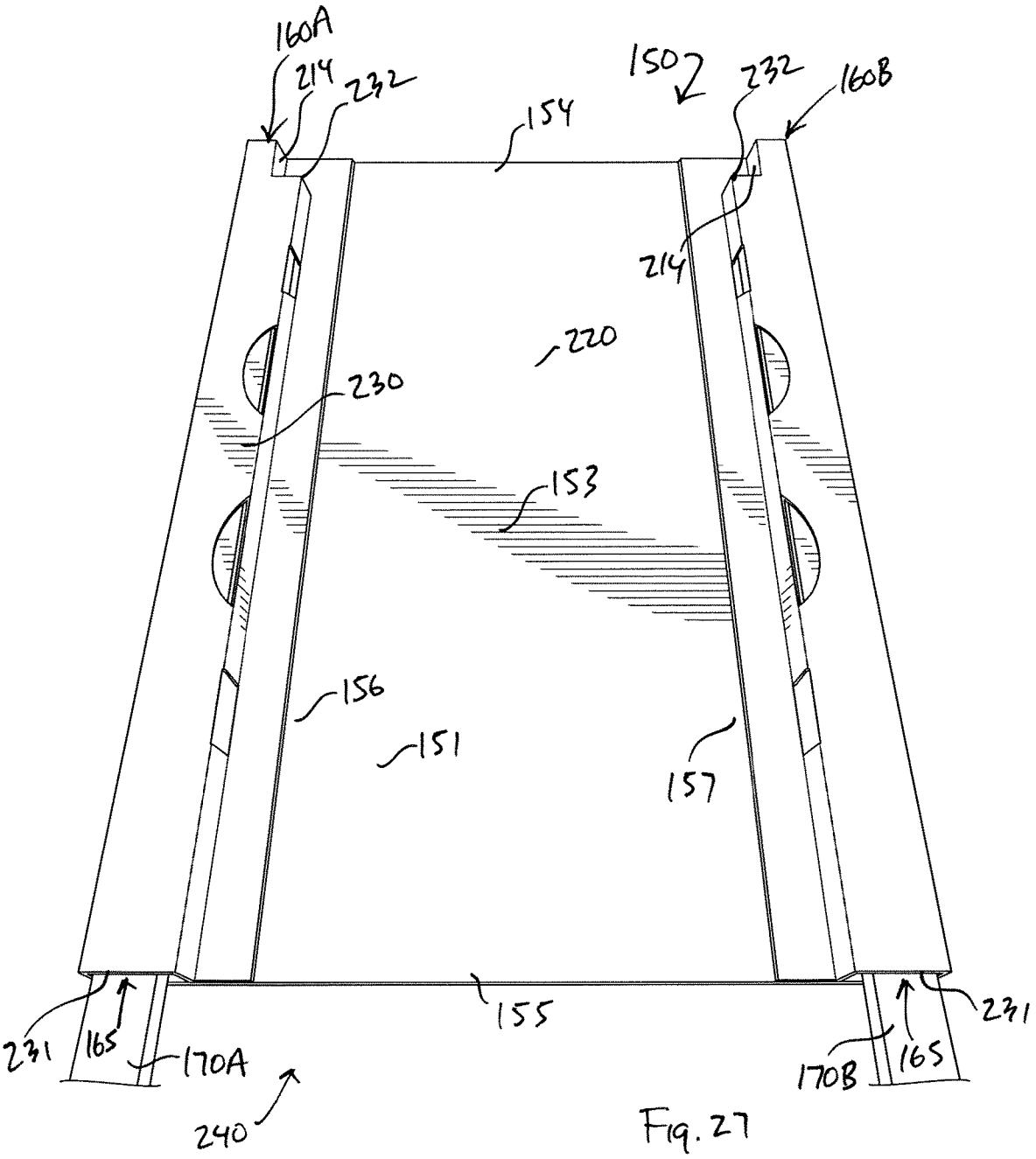
FIGS. 27 and 28 are downrange perspective views corresponding to FIGS. 22 and 23 illustrating a support pole inserted into each of the sleeve structures.
Figure 28:
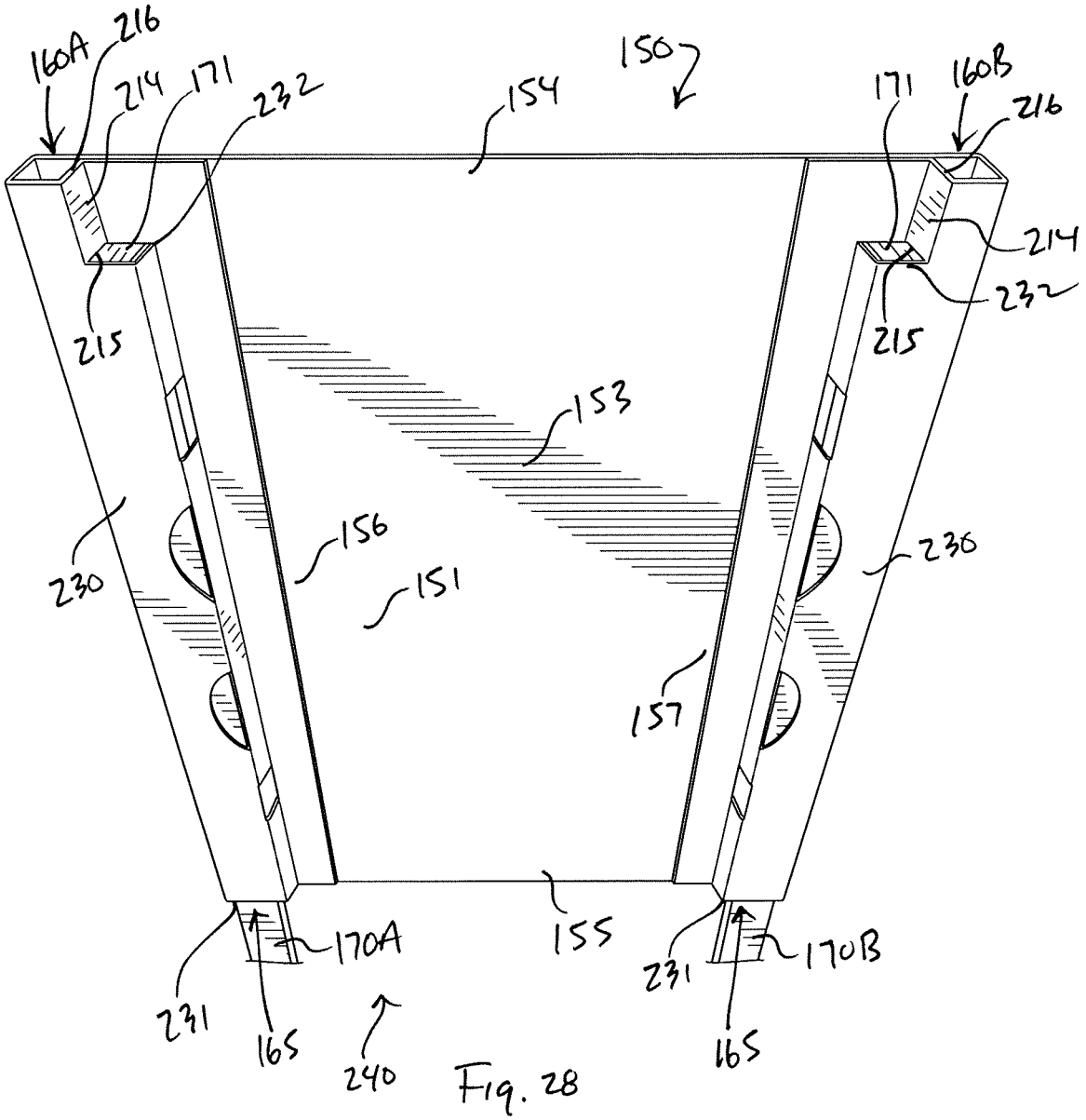
Figure 29:
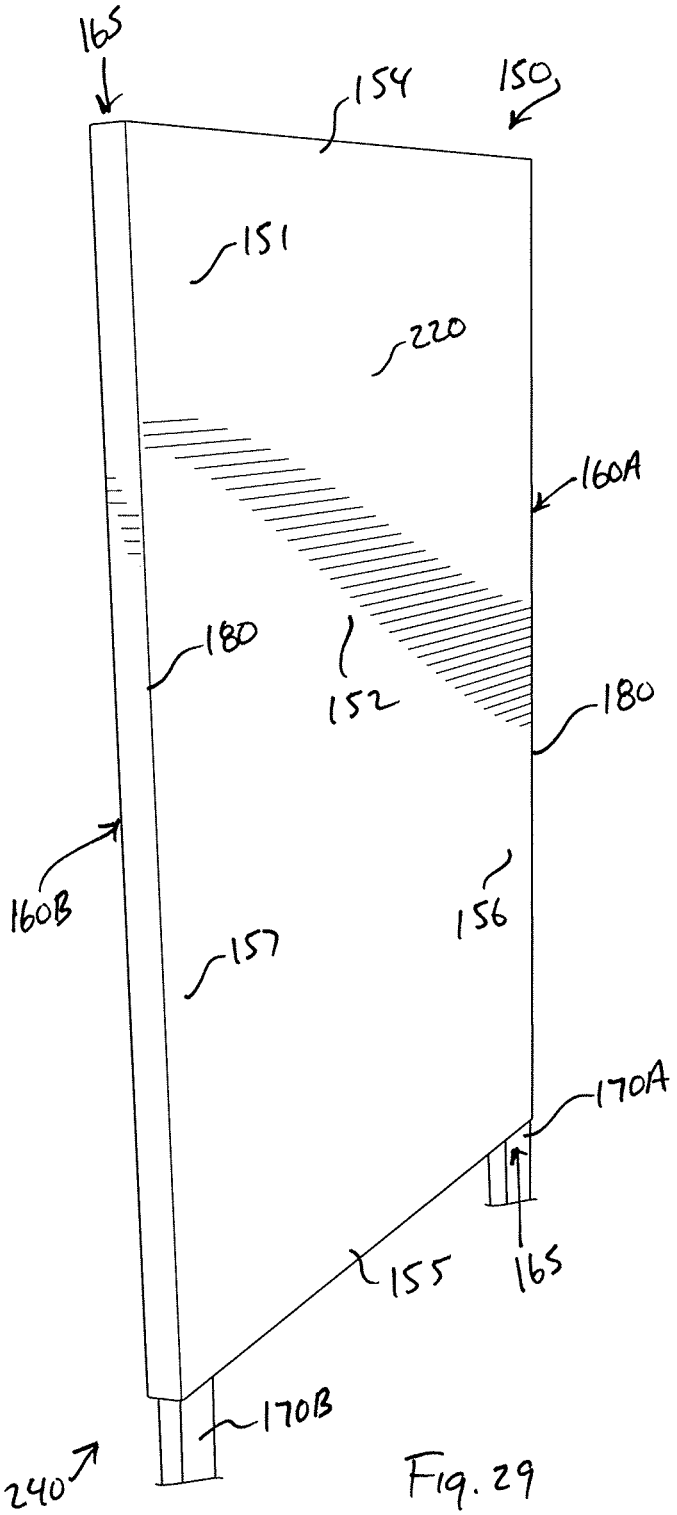
FIGS. 29 and 30 are uprange perspective views of the embodiment of FIGS. 27 and 28.
Figure 30:
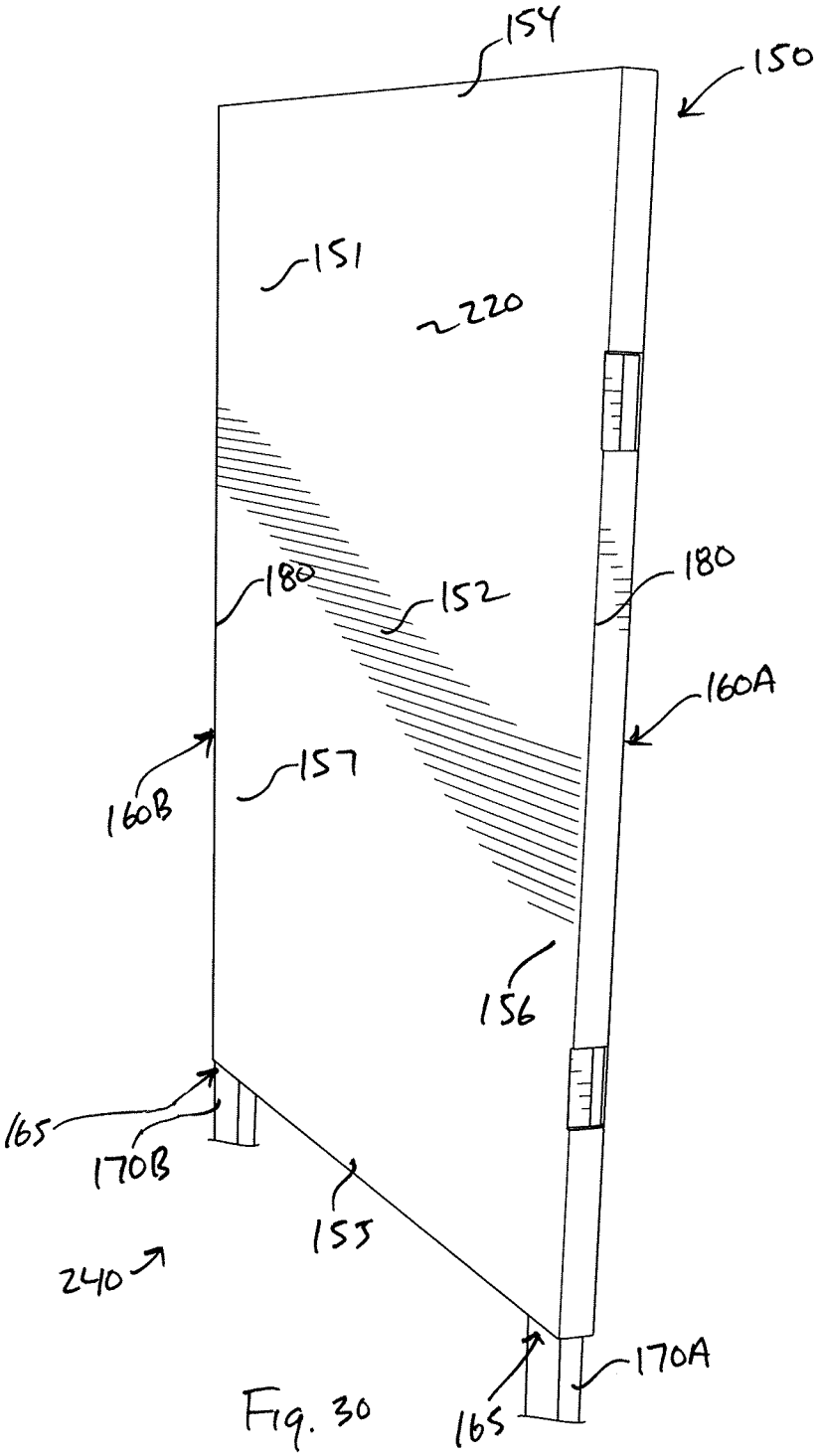

In FIGS. 27-30, hinged sleeves 160 are folded, each being in the folded/expanded condition forming sleeve structure 165, a support pole 170 is inserted into each of sleeve structures 165 to retain sheet 151 thereby on support poles 170, uprange-facing surface 152 is flat between hinged sleeves 160 and between upper end 154 and lower end 155 of sheet 151, and support poles 170 are behind downrange-facing surface 153 in FIGS. 27 and 28. When target 150 is installed on support poles 170, support poles 170 are supported upright, such as from a stand or from being staked into the ground, and extend upright to target 150 they support at an elevated location downrange from an uprange shooting area, in which uprange-facing surface 152 faces uprange toward the uprange shooting area, and downrange-facing surface 153 faces downrange. After target 150 positioned downrange is shot from an uprange shooting area a number of times, it may be removed from support poles 170 and replaced with another target constructed and arranged in accordance with the principle of the invention.

Hinged sleeves 160 are identical, each being the mirror image of the other, and are parallel relative to one another when unfolded and when folded. Accordingly, hinged sleeve 160A at side 156 of target 150 will now be discussed in detail, with the understanding that the ensuing discussion of hinged sleeve 160A applies in every respect to hinged sleeve 160B at side 157 of target 150.

Referring to FIGS. 17 and 18, hinged sleeve 160A includes hinge 180, and flap section 190, each formed in the material of sheet 51. Hinge 180 is a living hinge, known by the skilled person as a thin and/or cut, inherently flexible hinge formed in the material of sheet 151 that exhibits inherently minimal friction and inherently little wear and which is inherently low in cost and easy to form in cardboard, the chosen material of sheet 151. Hinge 180 extends from lower end 155 of sheet 151 to upper end 154 of sheet 151, divides sheet 151 into outer flap section 190 of sheet 151 and inner center section 220 of sheet 151, and hinges flap section 190 to center section 220. Center section 220 of sheet 151 extends between upper end 154 and lower end 155, and between hinged sleeves 160A and 160B, and is flat, in which uprange-facing surface 152 of center section 220 and downrange-facing surface 153 of center section 220 are parallel relative to each other. Flap section 190 includes upper end 191, lower end 192, outer extremity 193 that extends from upper end 191 to lower end 192, and length L' from upper end 191 to lower end 192. Hinge 180 extends along length L of flap section 190 from upper end 191 to lower end 192, and flap section 190 extends from hinge 180 to outer extremity 193, that extends along the length of flap section 190 from upper end 191 to lower end 192.

Outer extremity 193 of flap section 190 is folded inwardly over downrange-facing surface 153 of center section 220 in FIGS. 17-20, the downrange-facing surface 153 of outer extremity 193, along the length L' of flap section 190 from upper end 191 to lower end 192, and is applied flat against, and is adhered adhesively to, downrange-facing surface 153 of center section 220 from upper end 154 of center section 220 of sheet 151 to lower end 155 of center section 220 of sheet 151. Referring to FIGS. 17-21 in relevant part, five sleeve hinges are formed in the material of flap section 190 of sheet 151 including, from hinge 180 to outer extremity 193, hinge 200, hinge 201, hinge 202, hinge 203, and hinge 204. Hinges 200-204 are spaced apart, are parallel relative to each other and to hinge 180 and are identical to hinge 180, each being a living hinge formed in the material of sheet 51. Hinge 200 is between hinge 180 and hinge 201, hinge 201 is between hinge 200 and hinge 202, hinge 202 is between hinge 201 and hinge 203, and hinge 203 is between hinge 202 and hinge 204.

Hinge 200 is adjacent to hinge 180, and extends from upper end 191 of flap section 190 to lower end 192 of flap section 190. Flap section 190 is cut partially along cut line 196 proximate to upper end 191. Cut line 196 is parallel to upper end 191 of flap section 190 and to upper and lower ends 154 and 155 of sheet 151, and extends from the uppermost end of hinge 204 proximate to upper end 191 of flap section 190 and upper end 154 of sheet 151 to the lowermost end of hinge 201 from where hinge 201 extends upwardly therefrom to upper end 191. Hinge 204 extends downwardly from its uppermost end at cut line 196 to lower end 192 of flap section 190. Hinge 203 is adjacent to hinge 204, and extends downwardly from cut line 196 to lower end 192 of flap section 190. Hinge 202 between hinge 201 and hinge 203 extends upwardly from cut line 196 to upper end 191 of flap section 190.

Other than outer extremity 193, flap section 190 is not affixed to downrange-facing surface of center section 220 from hinges 204 and 202 forming a loop with center section 220 at side 156 of sheet 151 and flap section 190 which extends from hinges 204 and 203, the loop being defined by a side 210 of center section 220 from hinges 204 and 203 to hinge 180, side/panel 211 from hinge 180 to hinge 200, side/panel 212 from hinge 200 to hinge 203, side/panel 213 from hinge 203 to hinge 204, and short side/panel 214 from hinge 201 to hinge 202, in which short side 214 is between hinge 200 and hinge 203, and extends from edge 215 of side 214 at cut line 196 to edge 216 that forms a part of upper end 191. Sides/panels 210-214 are parallel relative to each other and relative to hinges 180 and 200-204. The width of side 210 from hinge 204 to hinge 180 is equal to the width of side 212 from hinge 200 to hinge 203. The width of side 211 from 180 to hinge 200, the width of side 213 from hinge 203 to hinge 204, and the width of short side 214 from hinge 201 to hinge 202 are equal, and are each less than the width of each of sides 210 and 212. Sleeve hinges 180 and 200-204, cut line 206, and sides 210-214 cooperate to form hinged sleeve 160A. Sides 210-214 are each flat, each being a flat panel.

Hinged sleeve 160A is foldable from its unfolded condition in FIGS. 17-20 to its folded condition in FIGS. 22-26. In FIGS. 17-20, side 211 is unfolded at and outwardly from hinge 180 to hinge 200 and sides 210 and 211 are flat, side 212 is folded 180 degrees in the opposite direction inwardly from hinge 200 and sides 212, 213 and 214 are flattened in a direction toward and against downrange-facing surface 153 of center section 220 and sides 212, 213, and 214 are flat and are parallel relative to sides 210 and 211, when hinged sleeve 160A is in the unfolded condition. Accordingly, hinged sleeve 160A is collapsed in a direction toward downrange-facing surface 153 of center section 220 of sheet 51 and is closed and thereby disabled from receiving a support pole therein, when hinged sleeve 160A is in the described unfolded condition.

Side 211 folds at hinge 180 rearwardly from downstream facing surface 153, side 213 folds at hinge 204 rearwardly from downstream-facing surface 153, short side 214 folds at hinge 202 rearwardly from downstream-facing surface 153, and side 212 folds at hinge 200 inwardly from side 211 to hinge 201 and from hinge 201 to hinge 203, when hinged sleeve 160A is folded from its unfolded condition to its folded condition. Cut line 196 enables side 214 and sides 212 and 213 to pop out and deploy rearwardly from flap section 190 when hinged sleeve 160A hingedly articulates from its unfolded condition to its folded condition. Because hinges 180 and 200-204 are parallel to each other, and sides 210-214 are parallel to each other and to hinges 180 and 200-204, four sides 210-213, and also side 214, are inherently enabled to concurrently hingedly translate at hinges 180 and 200-204 in parallel planes, when hinged sleeve 160A is folded from the unfolded condition of hinged sleeve 160A to the folded condition of hinged sleeve 160A. Hinged sleeve 160A is deployed rearwardly from downrange-facing side 153 of center section 220 at side 156, in which side 211 is folded at hinge 180 rearwardly from downstream facing surface 153 to hinge 200 at side 212 and is perpendicular relative to downrange-facing surface 153, side 213 is folded at hinge 204 rearwardly from downstream-facing surface 153 to hinge 203 at side 212 and is perpendicular relative to downrange-facing surface 153, short side 214 is folded at hinge 202 rearwardly from downstream-facing surface 153 to hinge 201 at side 212 and is perpendicular relative to downrange-facing surface 153, side 212 is folded at hinge 200 inwardly from side 211 to hinge 201 at side 214 and from hinge 201 to hinge 203 at side 213 and is spaced rearwardly apart from and is perpendicular relative to downrange-facing surface 153, sides 211 and 213 are parallel relative to each other and are perpendicular relative to sides 212 and side 210. In other words, hinged sleeve 160A is deployed rearwardly from downrange-facing side 153 of center section 220 at side 156, in which side 211 is folded rearwardly from and is perpendicular to downstream facing surface 153 side 212, side 213 is folded at hinge 204 rearwardly from and is perpendicular to downstream-facing surface 153 to side 212, short side 214 is folded at hinge 202 rearwardly from and is perpendicular to downstream-facing surface 153 to side 212, side 212 is folded at hinge 200 inwardly from side 211 to side 214 and to side 213 and is spaced rearwardly from and is perpendicular to downrange-facing surface 153 and side 210, and sides 211 and 213 are parallel relative to each other and are perpendicular relative to sides 212 and side 210, forming sleeve structure 165, in which and sides 210, 211, 212, and 213 define a generally rectangular sleeve 230 having open end 231, closed end 232, and that encircles a support pole receiving area that extends from open end 231 at lower end 155 defined by sides 210, 211, 212, and 213 to closed end 232 at cut line 196 defined by sides 210, 211, 212, 213, and 214, when hinged sleeve 160A is in the folded condition. Hinged sleeve 160A is deployed rearwardly from downrange-facing side 153 of center section 220 at side 156 to define sleeve 230 that is open from open end 231 to closed end 232 and thereby enabled for receiving a support pole therein from open end 231 to closed end 232, when hinged sleeve 160A is in the folded condition. End 232 is closed by side 214, specifically by edge 215 of side 214, between side 213 and side 211.

Hinged sleeve 160A is folded from its unfolded condition to its folded condition by hand. When hinged sleeve 160A is folded from its unfolded condition to its folded condition, the concurrent folding of sides 210-214, which hingedly articulate at hinges 180 and 200-204 from their unfolded conditions to their folded conditions, can be coaxed by hand. To unfold hinged sleeve 160A from its folded condition to its unfolded condition, the described operation of folding hinged sleeve 160A from its folded condition to its unfolded condition need only be reversed, in which sides 210-214 automatically hingedly articulate at hinges 180 and 200-204 to resume their unfolded conditions, in which the unfolding of sides 210-214 from their folded conditions to their unfolded conditions can be coaxed by hand. Because hinges 180 and 200-204 are parallel to each other, and sides 210-214 are parallel to each other and to hinges 180 and 200-204, four sides 210-213, and also side 214, are inherently enabled to concurrently hingedly translate at hinges 180 and 200-204 in parallel planes, when hinged sleeve 160A is unfolded from the folded condition of hinged sleeve 160A to the unfolded condition of hinged sleeve 160A. Cut line 196 enables side 214 and sides 212 and 213 to collapse toward downrange-facing surface 153 back to their unfolded conditions when hinged sleeve 160A hingedly articulates from its folded condition to its unfolded condition. Because hinged sleeve 160A includes hinges and cut line 196 that partially cuts out the loop of hinged sleeve 160A, hinged sleeve 160A is an origami structure as defined above, namely, a partially cut-out and foldable structure formed in the material, the cardboard, of sheet 151, being foldable from unfolded and folded conditions.

In FIGS. 22-26, hinged sleeves 160A and 160B are each folded, each being in the folded condition. As described previously, center section 220 of sheet 151 extends between upper end 154 and lower end 155, and between hinged sleeves 160A and 160B, and is flat, in which uprange-facing surface 152 of center section 220 and downrange-facing surface 153 of center section 220 are parallel relative to each other. This condition applies when hinged sleeves 160A and 160B are in their unfolded conditions, and when hinged sleeves 160A and 160B are in their folded conditions.

Figure 23:
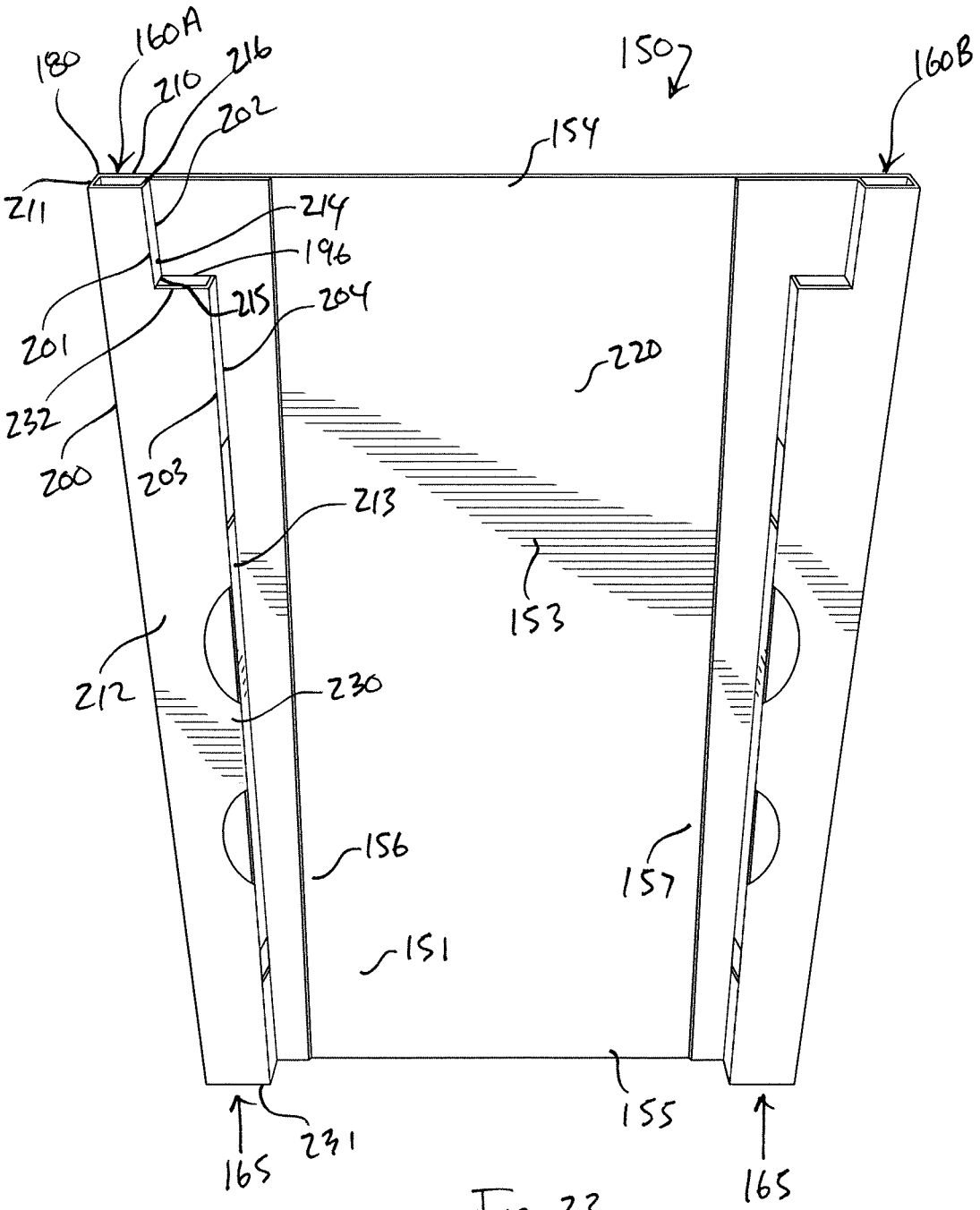
Figure 24:
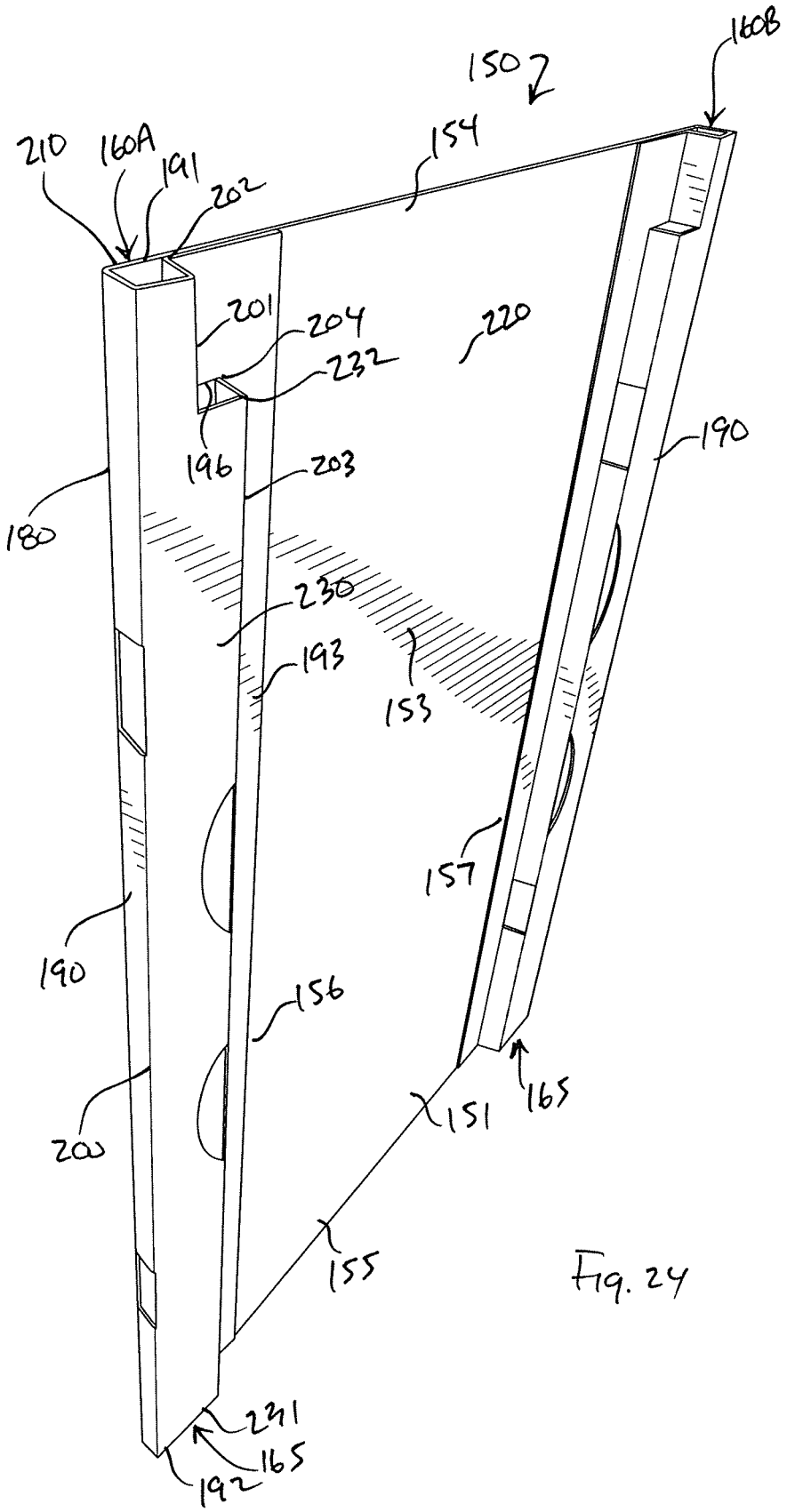
Figure 25:
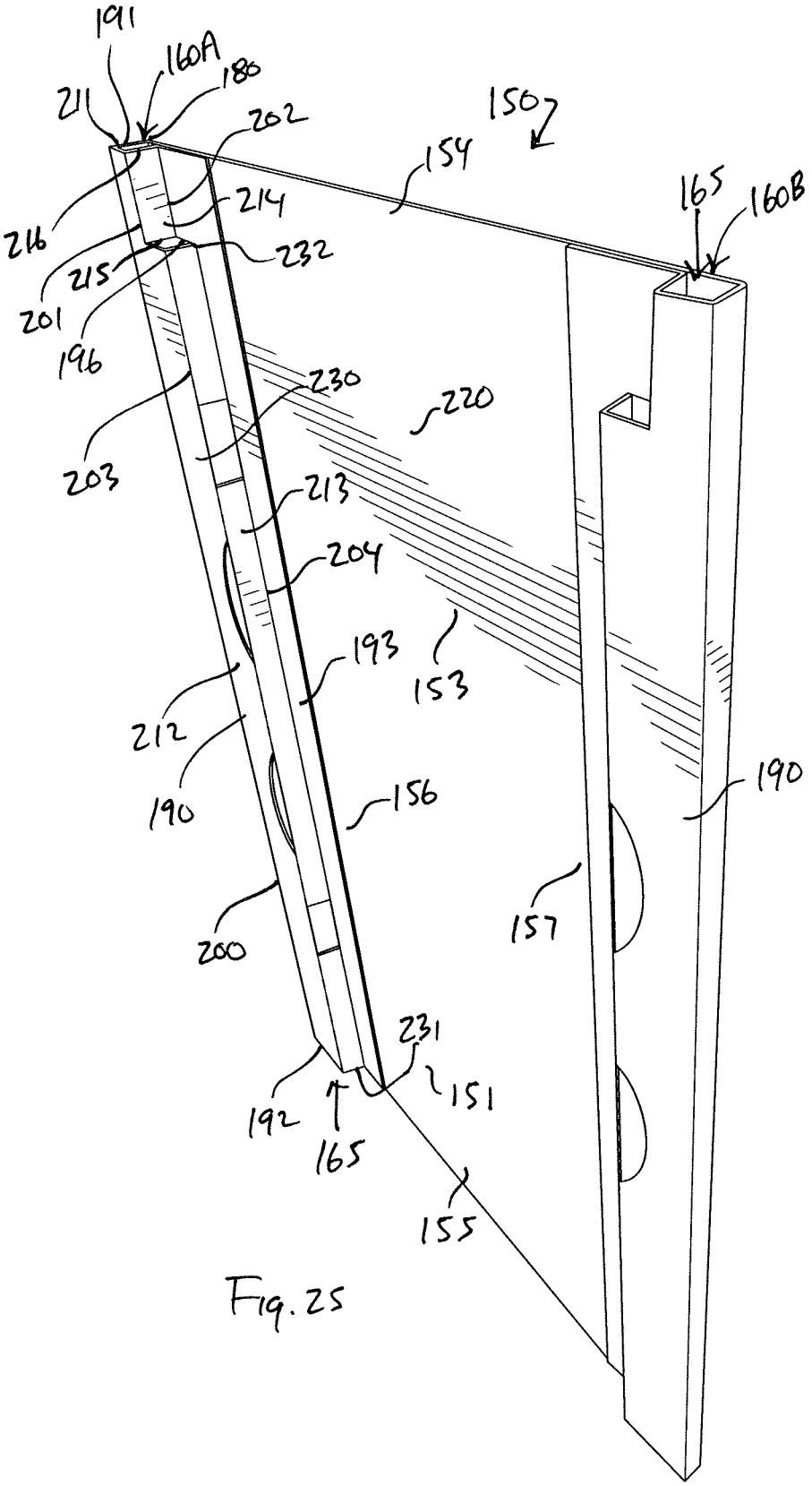
Figure 26:
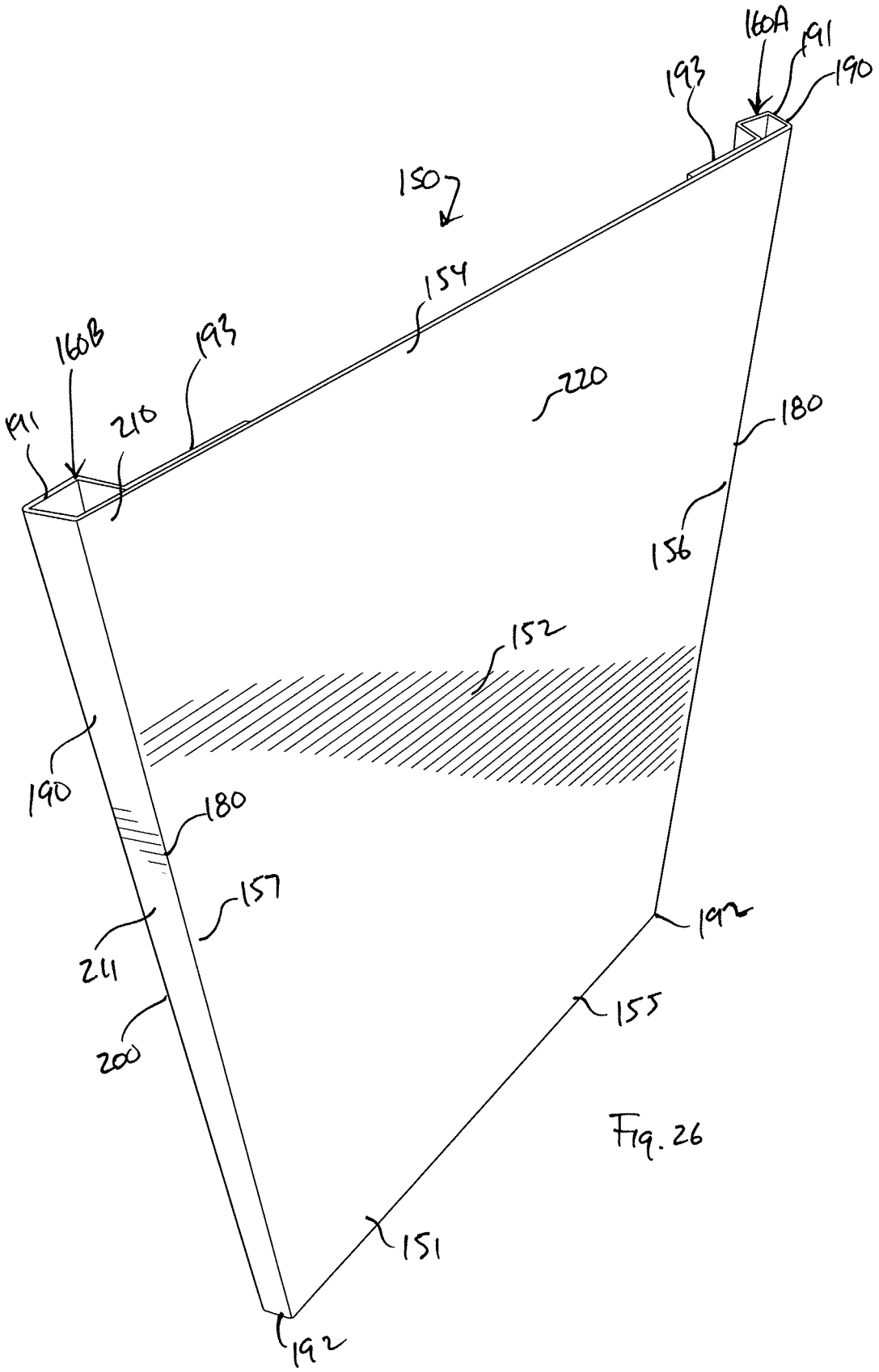
FIG. 26 is an uprange perspective view of the embodiment of FIGS. 22-25.
Figure 31:
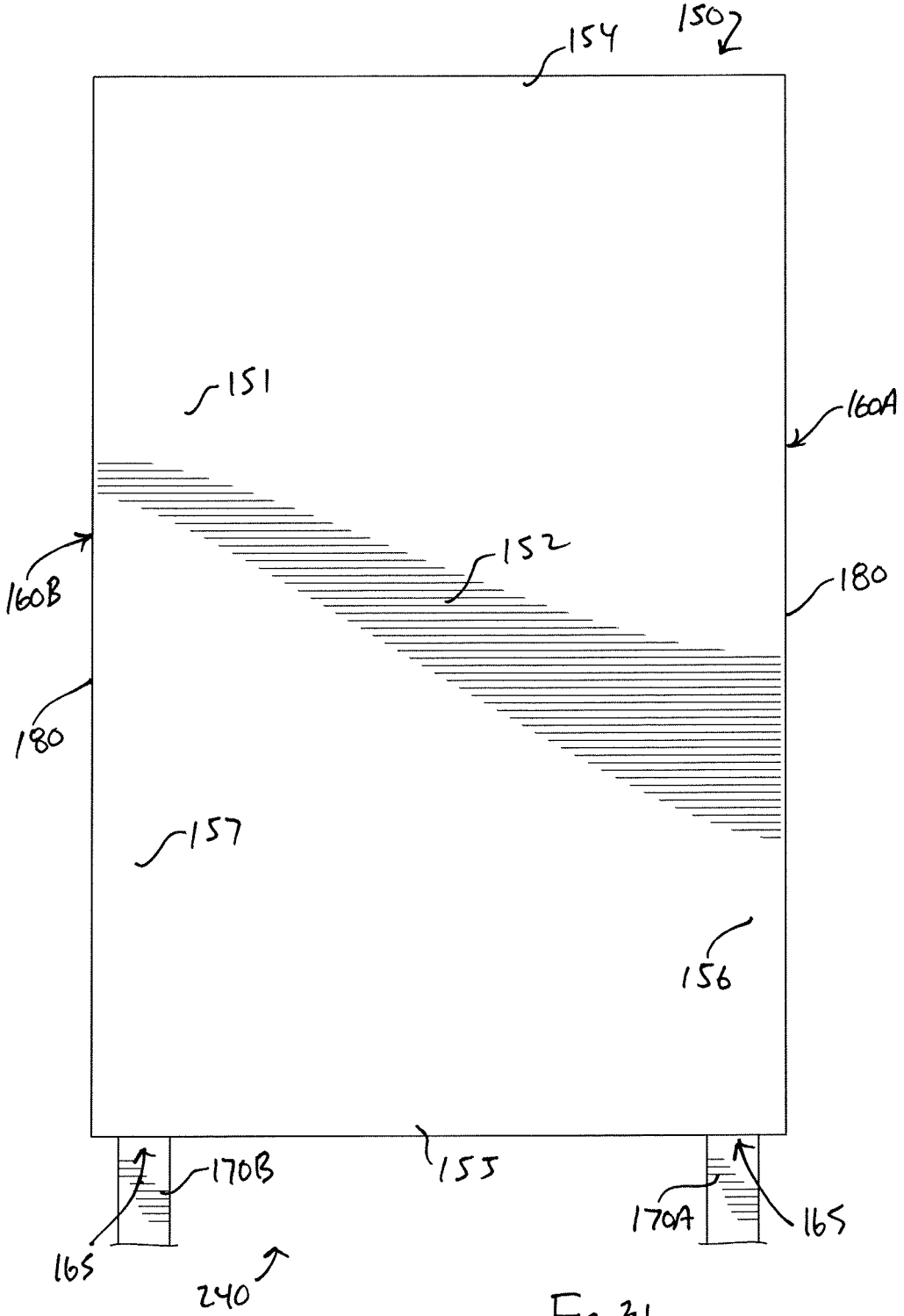
FIG. 31 is an uprange elevation view of the embodiment of FIGS. 29 and 30.

Hinged sleeves 160A and 160B are each disabled from receiving a support pole, when hinged sleeves 160A and 160B are in their unfolded conditions, their collapsed conditions. Hinged sleeves 160A and 160B are each enabled for receiving a support pole for retaining target 150 thereby to the support poles, when hinged sleeves 160A and 160B are in their folded conditions, their expanded conditions. In FIGS. 23 and 24, target 150 is folded, being in its folded condition, in which hinged sleeves 160A and 160B are folded being in their folded conditions, forming open sleeves in the respective sides 156 and 157 of sheet 151. Support poles 170A and 170B are inserted their upper ends 171 first in a direction from lower end 155 of sheet 151 to upper end 154 of sheet 151 into and through the open sleeves 230 through the respective open ends 231 formed by the deployed respective hinged sleeves 160A and 160B until their upper ends 171 directly contact/engage edges 215 of respective sides 214 at the respective closed ends 232, to retain sheet 151 thereby on support poles 170 to form target assembly 240. When upper ends 171 directly contacts sides 214 at the respective ends 232, sides 214 inherently disable the respective upper ends 171 from moving beyond ends 231, which characterizes the closed nature of ends 231. Target 150 is retained to support poles 170A and 170B when target 150 is in its unfolded/expanded condition and when support poles 170A and 170B are inserted through open sleeves 230 of the respective sleeves 160A and 160B and the ends 171 of support poles 170A and 170B are, at the same time, received in direct contact against edges 215 of the respective sides 214. When target 150 is installed on support poles 170 in FIGS. 27-31 to form target assembly 240, the lower ends of support poles 170 are supported upright, such as from a stand or from being staked into the ground, and extend upright to target 150 they support at an elevated location downrange from an uprange shooting area, in which uprange-facing surface 152 faces uprange toward the uprange shooting area, and downrange-facing surface 153 faces downrange. In target assembly 240 in FIGS. 29-31, uprange-facing surface 152 is flat between hinged sleeves 160A and 160B and, more particularly, between hinges 180 of the respective hinged sleeves 160A and 160B, and between upper end 154 and lower end 155 of sheet 151, and the support poles 170 are behind center section 100 proximate to either side 156 and 157 of target 150 behind downrange-facing surface 153 of center section 220 as illustrated in FIGS. 27 and 28, in which uprange-facing surface 152 facing uprange toward an uprange shooting area provides a flat target area for shooting at in target shooting, according to the principle of the invention. To remove target 150 from support poles 170A and 170B, the foregoing operation for installing target 150 onto support poles 170A and 170B need only be reversed for withdrawing support poles 170A and 170B from the sleeve structures of the respective hinged sleeves 160A and 160B.

Target 150 is useful in that it is easy to construct, inexpensive, easy to adjust by hand from its unfolded condition to its folded condition, and is easily mounted to support poles by hand to form a useful target assembly 240 when target 150 is in its folded condition. After target 150 positioned downrange is shot from an uprange shooting area a number of times, it may be removed and replaced with another target constructed and arranged in accordance with the principle of the invention.

III

The present invention is described above with reference to illustrative embodiments. However, those skilled in the art will recognize that changes and modifications may be made in the described embodiments without departing from the nature and scope of the present invention. Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A target, comprising:

a sheet of a material, the sheet including an uprange-facing surface, a downrange-facing surface, an upper end, a lower end, opposed sides, and a hinged sleeve formed in each of the opposed sides, each said hinged sleeve is formed in the material of the sheet, and is hingedly foldable from an unfolded condition collapsed in a direction toward the downrange-facing surface of the sheet being disabled from receiving a support pole therein to a folded condition deployed rearwardly from the downrange-facing surface of the sheet being enabled for receiving a support pole therein; and each said hinged sleeve including hinged panels and an additional panel hinged to two of the hinged panels, the hinged panels and the additional panel concurrently translate hingedly from the unfolded condition of the hinged sleeve to the folded condition of the hinged sleeve to define a support pole-receiving sleeve by the hinged panels including an open first end proximate to the lower end of the sheet and a second end proximate to the upper end of the sheet and that is closed by the additional panel.

2. The target according to claim 1, wherein the sheet is flat, when each said hinged sleeve is in the unfolded condition.

3. The target according to claim 1, wherein the second end of the sleeve is closed by an edge of the additional panel, when each said hinged sleeve is in the unfolded condition.

4. The target according to claim 1, wherein the material is a cardboard.

5. A target, comprising:

a sheet of a material, the sheet including an uprange-facing surface, a downrange-facing surface, an upper end, a lower end, opposed sides, and a hinged sleeve formed in each of the opposed sides, each said hinged sleeve is formed in the material of the sheet, and is hingedly foldable from an unfolded condition collapsed in a direction toward the downrange-facing surface of the sheet being disabled from receiving a support pole therein to a folded condition deployed rearwardly from the downrange-facing surface of the sheet being enabled for receiving a support pole therein;

each said hinged sleeve including panels connected by hinges and an additional panel connected to two of the panels by a first hinge and a second hinge, respectively, the panels and the additional panel concurrently translate hingedly, the panels at the hinges and the additional panel at the first hinge and the second hinge, from the unfolded condition of the hinged sleeve to the folded condition of the hinged sleeve to define a support pole-receiving sleeve by the panels including an open first end proximate to the lower end of the sheet and a second end proximate to the upper end of the sheet and that is closed by the additional panel; and the hinges, the first hinge, and the second hinge are parallel relative to one another.

6. The target according to claim 5, wherein the sheet is flat, when each said hinged sleeve is in the unfolded condition.

7. The target according to claim 5, wherein the second end of the sleeve is closed by an edge of the additional panel, when each said hinged sleeve is in the unfolded condition.

8. The target according to claim 5, wherein the material is a cardboard.

* * * * *